US012515112B2

(12) United States Patent
Kaplan et al.

(10) Patent No.: US 12,515,112 B2
(45) Date of Patent: Jan. 6, 2026

(54) GOLF CLUB HEAD COMPRISING MICROSPHERES

(71) Applicant: Topgolf Callaway Brands Corp., Carlsbad, CA (US)

(72) Inventors: Michael Kaplan, East Amherst, NY (US); Joshua D. Westrum, San Diego, CA (US); Eric Stubben, Encinitas, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 790 days.

(21) Appl. No.: 17/941,855

(22) Filed: Sep. 9, 2022

(65) Prior Publication Data

US 2023/0001273 A1 Jan. 5, 2023

Related U.S. Application Data

(60) Continuation-in-part of application No. 17/399,260, filed on Aug. 11, 2021, now Pat. No. 11,771,966, which is a continuation of application No. 16/996,038, filed on Aug. 18, 2020, now Pat. No. 11,090,534, which is a continuation of application No. 16/540,917, filed on Aug. 14, 2019, now Pat. No. 10,744,379, which is a continuation-in-part of application No. 16/241,859, filed on Jan. 7, 2019, now Pat. No. 10,653,930, which is a continuation of application No. 15/927,917, filed on Mar. 21, 2018, now Pat. No. 10,173,108, which is a continuation-in-part of application No. 15/807,851, filed on Nov. 9, 2017, now Pat. No. 10,052,535, which is a continuation-in-part of application No. 15/718,285, filed on Sep. 28, 2017, now Pat. No. 10,039,964, which is a division of application No. 15/665,004, filed on Jul. 31, 2017, now Pat. No. 9,808,685.

(60) Provisional application No. 62/457,086, filed on Feb. 9, 2017.

(51) Int. Cl.
*A63B 53/04* (2015.01)
*A63B 60/00* (2015.01)

(52) U.S. Cl.
CPC ..... *A63B 53/0475* (2013.01); *A63B 60/00* (2015.10); *A63B 60/002* (2020.08); *A63B 2209/00* (2013.01)

(58) Field of Classification Search
CPC . A63B 53/0475; A63B 60/00; A63B 2209/00; A63B 60/002
USPC ..... 473/324–350, 287–292
See application file for complete search history.

(56) References Cited

U.S. PATENT DOCUMENTS 4,650,626 A * 3/1987 Kurokawa ..... B29C 70/72 264/328.5
5,068,902 A * 11/1991 Ward ..... B29C 70/66 381/328

(Continued)

*Primary Examiner* — Sebastiano Passaniti
(74) *Attorney, Agent, or Firm* — Michael A. Catania

(57) ABSTRACT

A putter-type golf club head having a body with a face insert composed of a cast urethane and glass microspheres is disclosed herein, as are methods of making face inserts with a polymer-microsphere mixture. The microspheres are non-uniformly distributed within the cast urethane to have a greater concentration of the microspheres at one section of the insert. The microspheres include K, S, iM, and XLD microspheres.

3 Claims, 21 Drawing Sheets

(56) References Cited

U.S. PATENT DOCUMENTS

| | | | | |
|---|---|---|---|---|
| 5,672,120 | A * | 9/1997 | Ramirez | A63B 53/047 473/347 |
| 5,807,190 | A * | 9/1998 | Krumme | A63B 53/0466 473/329 |
| 6,273,279 | B1 * | 8/2001 | Wolf | A63B 55/408 24/372 |
| 9,808,685 | B1 * | 11/2017 | Westrum | A63B 53/047 |
| 2002/0016219 | A1 * | 2/2002 | Halko | A63B 53/0487 473/340 |
| 2002/0025423 | A1 * | 2/2002 | Dreher | C08J 9/32 428/319.3 |
| 2003/0220156 | A1 * | 11/2003 | Solheim | A63B 60/00 473/340 |
| 2005/0020378 | A1 * | 1/2005 | Krumme | A63B 53/04 473/340 |
| 2007/0149311 | A1 * | 6/2007 | Wright | A63B 53/0487 473/340 |
| 2007/0243949 | A1 * | 10/2007 | Solari | A63B 53/08 473/340 |
| 2008/0058117 | A1 * | 3/2008 | Roach | A63B 53/047 473/332 |
| 2008/0166558 | A1 * | 7/2008 | Baran, Jr. | C09C 1/3072 428/403 |
| 2010/0009159 | A1 * | 1/2010 | Kimberly | B29C 70/60 428/338 |
| 2010/0184527 | A1 * | 7/2010 | Demkowski | A63B 69/3685 473/340 |
| 2012/0040174 | A1 * | 2/2012 | Adams | B32B 3/12 524/502 |
| 2018/0221725 | A1 * | 8/2018 | Westrum | A63B 53/04 |

* cited by examiner

GOLF CLUB HEAD COMPRISING MICROSPHERES

CROSS REFERENCES TO RELATED APPLICATIONS

The present application a continuation-in-part of U.S. patent application Ser. No. 17/399,260, filed on Aug. 11, 2021, which is a continuation of U.S. patent application Ser. No. 16/996,038, filed on Aug. 18, 2020, and issued on Aug. 17, 2021, as U.S. Pat. No. 11,090,534, which is a continuation of U.S. patent application Ser. No. 16/540,917, filed on Aug. 14, 2019, and issued on Aug. 18, 2020, as U.S. Pat. No. 10,744,379, which is a continuation-in-part of U.S. patent application Ser. No. 16/241,859, filed on Jan. 7, 2019, and issued on May 19, 2020, as U.S. Pat. No. 10,653,930, which is a continuation of U.S. patent application Ser. No. 15/927,917, filed on Mar. 21, 2018, and issued on Jan. 8, 2019, as U.S. Pat. No. 10,173,108, which is a continuation-in-part of U.S. patent application Ser. No. 15/807,851, filed on Nov. 8, 2017, and issued on Aug. 21, 2018, as U.S. Pat. No. 10,052,535, which is a continuation-in-part of U.S. patent application Ser. No. 15/718,285, filed on Sep. 28, 2017, and issued on Aug. 7, 2018, as U.S. Pat. No. 10,039,964, which is a division of U.S. patent application Ser. No. 15/665,004, filed on Jul. 31, 2017, and issued on Nov. 7, 2017, as U.S. Pat. No. 9,808,685, which claims priority to U.S. Provisional Patent Application No. 62/457,086, filed on Feb. 9, 2017, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head comprising a novel polymeric material that coats at least a portion of a rear surface of the striking face, which improves the sound of the club head without significantly reducing the golf club head's ball speed or coefficient of restitution.

Description of the Related Art

Golf club heads, and particularly iron-type golf club heads, often include polymeric materials disposed behind the striking face to improve or dampen the sound of the head upon impact with a golf ball. For example, U.S. Pat. No. 5,492,327 discloses an iron with a damping material in a recess, U.S. Pat. No. 6,743,117 discloses a dampening insert behind a strike face insert in an iron, and U.S. Pat. No. 9,168,437 discloses an elastomeric insert attached to the back of the striking face of an iron. Unfortunately, while a polymer fill or insert can improve the sound of the golf club in which it is disposed, this configuration reduces ballspeed off the face, as well as the coefficient of restitution (COR) of the golf club head. This occurs because polymers such as urethane are rigid, with a Poisson's ratio of around 0.5, and when a polymer fills a cavity or space, the polymer prevents the golf club face from flexing. Therefore, there is a need for a golf club head comprising an improved damping material that also preserves, or otherwise optimizes, ballspeed and COR values.

BRIEF SUMMARY OF THE INVENTION

The golf club head comprises a novel material comprising microscopic bubbles (also referred to as hollow beads) made from a strong, lightweight, low-density material such as glass, ceramic, and/or plastic, mixed with a polymeric material, preferably urethane or silicone, at least partially coating a rear surface of a variable thickness striking face. The presence of the microscopic bubbles in the polymeric material prevents the COR of the golf club head from decreasing by more than 0.10, and more preferably by more than 0.05, when compared with a golf club head having all of the same features and characteristics but which lacks a polymeric fill material completely. The fill material is preferably injection molded onto a back surface of the golf club face to fill variable thickness topography and level the rear surface of the golf club face to allow for the attachment of one or more medallions.

One aspect of the present invention is a golf club head comprising a body comprising a striking face, a sole portion, a top portion, a rear portion, and a cavity, and a fill material comprising a first material and a plurality of microscopic bubbles composed of a second material, wherein the second material is different from the first material, wherein the striking face comprises a nonplanar rear surface, wherein the fill material covers at least a portion of the nonplanar rear surface to create a flat plane, and wherein the plurality of microscopic bubbles constitutes 5% to 70% of a volume of the fill material. In some embodiments, the golf club head further comprises a medallion and an adhesive material, and the medallion is affixed to the flat plane with the adhesive material. In a further embodiment, the medallion may comprise or be composed of the fill material.

In yet another embodiment, the golf club head of claim may further comprise a weight, which may be disposed within the cavity. In a further embodiment, the weight may comprise a tungsten alloy. In a further embodiment, the weight may be at least partially enveloped in a urethane material to form a covered weight, which itself may be at least partially or completely enveloped in the fill material. In an alternative embodiment, a combination of the weight and the fill material may completely fill the cavity. In other embodiments, the golf club head may be an iron-type golf club head, each of the plurality of microscopic bubbles may have a diameter of approximately 18-50 microns, and the first material may have a Poisson's ratio of 0.00-0.50. In still other embodiments, the second material (from which the microscopic bubbles are made) may be selected from the group consisting of glass, ceramic, and plastic.

Another aspect of the present invention is a method comprising the steps of providing a golf club head comprising a variable thickness face component with a striking surface and a rear surface, wherein at least a portion of the rear surface is nonplanar, providing a fill material comprising a polymer material and a plurality of microscopic bubbles composed of a low-density material, providing a medallion sized to cover at least a portion of the rear surface, injecting the fill material onto the rear surface to create a flat surface, and affixing the medallion to the flat surface.

In a further embodiment, the method may comprise the step orienting the face component so that the striking surface is parallel with the ground plane, which step may occur prior to the step of injecting the fill material onto the rear surface to create a flat surface. In yet another embodiment, the step of providing a golf club head may comprise the step of casting the variable thickness face component from a metal alloy material. In yet another embodiment, the plurality of microscopic bubbles may constitute 25-30% of the volume of the fill material, and each of the plurality of microscopic bubbles may have a diameter of approximately 18-50 microns.

In another embodiment, the method may further comprise the step of inserting a weight with a density greater than 4 g/cc into a cavity of the golf club head. In a further embodiment, the method may comprise the step of injection-molding the fill material into the cavity and around at least a portion of the weight.

In another aspect, a golf club putter head is provided and includes a body comprising a striking face and a rear portion, where the striking face includes a cavity, an insert made up of a polymer and a plurality of microspheres distributed within the polymer, where the insert is affixed to the body in the cavity of the striking face.

In an embodiment of the golf club putter head aspect, the polymer is cast urethane.

In another embodiment of the golf club putter head aspect, the plurality of microspheres are ceramic microspheres.

In another embodiment of the golf club putter head aspect, the plurality of microspheres are selected from the group consisting of W-210, W-410 and W-610.

In another embodiment of the golf club putter head aspect, the plurality of microspheres are glass microspheres.

In another embodiment of the golf club putter head aspect, the microspheres are selected from the group consisting of K, S, iM, XLD, Floated series and HGS Series.

In another embodiment of the golf club putter head aspect, the microspheres are uniformly distributed within the polymer.

In another embodiment of the golf club putter head aspect, the microspheres are non-uniformly distributed within the polymer.

In another embodiment of the golf club putter head aspect, the insert has a striking face side and a rear side, and the plurality of microspheres are non-uniformly distributed within the polymer, such that there is a greater density of microspheres at the striking face side than at the rear side.

In another embodiment of the golf club putter head aspect, the insert has a striking face side and a rear side, and the plurality of microspheres are non-uniformly distributed within the polymer, such that there is a greater density of microspheres at the rear side than at the striking face side.

In another embodiment of the golf club putter head aspect, the insert has a top edge and a sole edge, and the plurality of microspheres are non-uniformly distributed within the polymer, such that there is a greater density of microspheres at the top edge than at the sole edge.

In another embodiment of the golf club putter head aspect, the insert has a top edge and a sole edge, and the plurality of microspheres are non-uniformly distributed within the polymer, such that there is a greater density of microspheres at the sole edge than at the top edge.

In another embodiment of the golf club putter head aspect, the insert has a heel edge and a toe edge, and the plurality of microspheres are non-uniformly distributed within the polymer, such that there is a greater density of microspheres at the heel edge than at the toe edge.

In another embodiment of the golf club putter head aspect, the insert has a heel edge and a toe edge, and the plurality of microspheres are non-uniformly distributed within the polymer, such that there is a greater density of microspheres at the toe edge than at the heel edge.

In another embodiment of the golf club putter head aspect, the insert has a heel edge, a toe edge and a center zone, and the plurality of microspheres are non-uniformly distributed within the polymer, such that there is a greater density of microspheres at the toe edge and the heel edge than at the center zone.

In another embodiment of the golf club putter head aspect, the insert has a heel edge, a toe edge and a center zone, and the plurality of microspheres are non-uniformly distributed within the polymer, such that there is a greater density of microspheres at the center zone than at the toe edge and the heel edge.

In another embodiment of the golf club putter head aspect, the insert has a first microsphere density zone and a second microsphere density zone, and the density of microspheres distributed in the first microsphere density zone is greater than the density of microspheres distributed in the second microsphere density zone.

In another embodiment of the golf club putter head aspect, the insert has a front section and a rear section, where the first microsphere density zone is generally coextensive with the front section and where the second microsphere density zone is generally coextensive with the rear section.

In another embodiment of the golf club putter head aspect, the insert has a front section and a rear section, where the first microsphere density zone is generally coextensive with the rear section and where the second microsphere density zone is generally coextensive with the front section.

In another embodiment of the golf club putter head aspect, the insert has a first microsphere density zone, a second microsphere density zone and a third microsphere density zone, and where the insert further comprises a center striking zone, a heel zone and a toe zone, where the first microsphere density zone is generally coextensive with the center striking zone, where the second microsphere density zone is generally coextensive with the heel zone, where the third microsphere density zone is generally coextensive with the toe zone, where the density of microspheres distributed in the first microsphere density zone is less than the density of microspheres distributed in the second microsphere density zone, and where the density of the microspheres distributed in the first microsphere density zone is less than the density of the microspheres distributed in the third microsphere density zone.

In another embodiment of the golf club putter head aspect, the microspheres comprise at least five percent of the insert, when measured on a weight-by-volume basis.

In another embodiment of the golf club putter head aspect, the microspheres comprise less than fifty percent of the insert, when measured on a weight-by-volume basis.

In another embodiment of the golf club putter head aspect, the microspheres comprise between five percent and fifty percent of the insert, when measured on a weight-by-volume basis.

In a further aspect, a method of making a golf club putter head insert is provided, which includes mixing a plurality of microspheres into a first quantity of polymer to produce a liquid polymer—microsphere mix, pouring the liquid polymer—microsphere mix into a mold, selecting a wait time, selecting a first cure time, then after the pouring step is completed, waiting for the wait time, such that a first quantity of the plurality of microspheres migrate from a first interior portion of the mold to a second interior portion of the mold, such that the concentration of microspheres in the first interior portion of the mold is less than the concentration of microspheres in the second interior portion of the mold, then after the wait time is completed, applying heat to the mold for the first cure time, so as to cure the liquid polymer—microsphere mix into a solid insert blank, removing the solid insert blank from the mold, and cutting the solid insert blank into a selected shape so as to form a finished putter insert.

In an embodiment of the method of making a putter insert, the method also includes selecting a mold-orientation angle with respect to the ground, positioning the mold at the selected mold-orientation angle, so as to use gravity to control the direction of the migration of the first quantity of the plurality of microspheres from a first interior portion of the mold to a second interior portion of the mold, by positioning the first interior portion of the mold and the second interior portion of the mold with respect to the ground.

In another embodiment of the method of making a putter insert, the method also includes, after the solid insert blank is cured, pouring a second quantity of liquid polymer into the mold, applying heat to the mold for the second cure time, so as to cure the second quantity liquid polymer and bonding the second quantity of liquid polymer to the solid insert blank.

In another embodiment of the method of making a putter insert, the method also includes selecting microspheres and polymer, where the plurality of microspheres have a first specific gravity and the first quantity of polymer has a second specific gravity, and where the first specific gravity is less than the second specific gravity, such that, during the wait time, the first quantity of the plurality of microspheres migrates in an upward direction from a first interior portion of the mold to a second interior portion of the mold due to the effect of gravity.

In another embodiment of the method of making a putter insert, the method also includes selecting hollow glass microspheres as the plurality of microspheres.

In another embodiment of the method of making a putter insert, the method also includes selecting microspheres and polymer, where the plurality of microspheres have a first specific gravity, the first quantity of polymer has a second specific gravity and the first specific gravity is greater than the second specific gravity, such that, during the wait time, the first quantity of the plurality of microspheres migrate in a downward direction from a first interior portion of the mold to a second interior portion of the mold due to the effect of gravity.

In another embodiment of the method of making a putter insert, the method also includes selecting ceramic microspheres as the plurality of microspheres.

In a further aspect, a method of making a golf club putter head insert is provided, which includes selecting a first polymer, pouring a first quantity of the first polymer into a sheet mold, curing the first quantity of the first polymer to form a first cured layer, mixing a plurality of microspheres into a second quantity of the first polymer to produce a liquid polymer—microsphere mix, then pouring the liquid polymer—microsphere mix into the sheet mold over the first cured layer, curing the poured liquid polymer—microsphere mix to form a second cured layer bonded to the first cured layer, so as to form a solid cured sheet, and then cutting the solid cured sheet into a selected shape so as to form a finished putter insert.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to golf club heads, particularly including both iron-type and putter-type golf club heads, which include a novel fill material comprising a polymeric material and a plurality of microscopic bubbles made of glass, ceramic, and/or plastic, also referred to herein as microscopic, hollow beads. The microscopic bubbles serve two purposes when incorporated with a polymeric material: (1) they lighten the overall fill weight by replacing elastomer with air, thus lowering the material's specific gravity; and (2) they increase the porosity of the fill material, allowing for the formation of micro-holes in the polymeric material. The micro-holes are little air pockets that allow the polymer to flex when the club head impacts a golf ball, thus increasing the COR of the head while at the same time maintaining the sound improvement provided by the polymer itself, such as reduction in dB level and duration. The polymeric material preferably is an elastomer such as polyurethane or silicone having a Poisson's ratio of 0.00-0.50, and more preferably 0.40-0.50, and the microscopic bubbles preferably are measured in D50 micron, which is the median particle size for a measured sample, each microscopic bubble having a diameter of approximately 18-50 microns.

Figure 1:
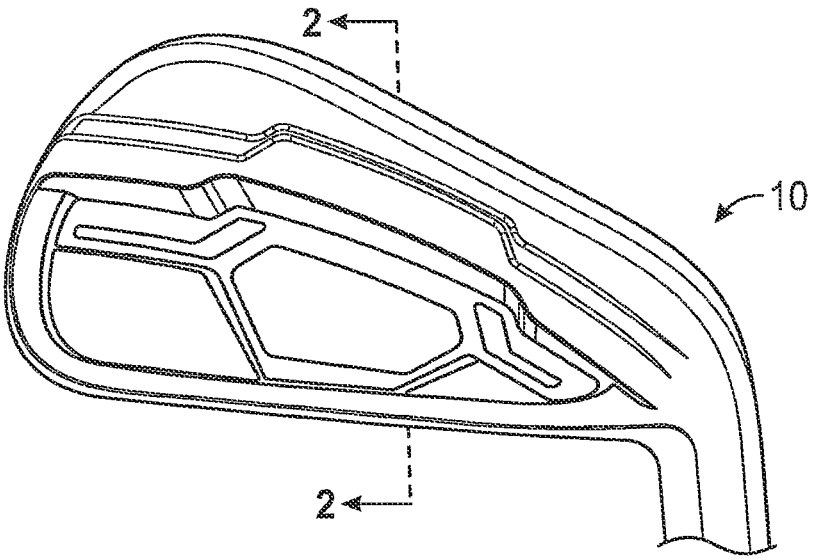
FIG. 1 is a rear elevational view of an iron-type golf club head of the present invention.
Figure 2:
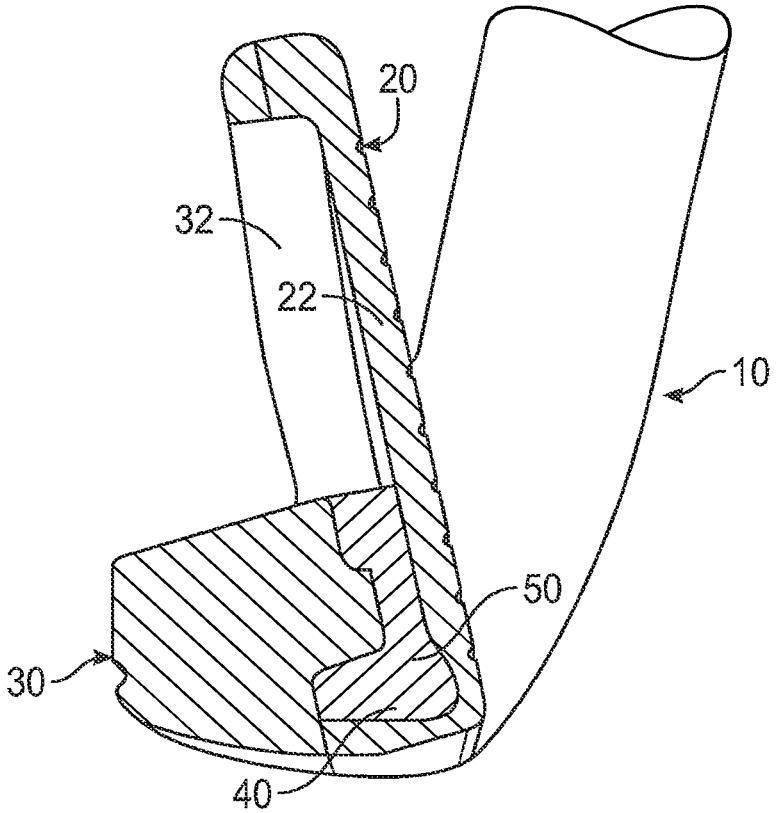
FIG. 2 is a cross-sectional view of the embodiment shown in FIG. 1 along lines 2-2.

A first embodiment of the golf club head is shown in FIGS. 1 and 2. In this embodiment, the golf club head 10 is a cavity back iron having a face cup 20, a body 30, and a cavity 40 between the body and the striking portion 22 of the face cup. The cavity 40 is completely filled with the microscopic bubble fill material 50, which does not extend into the upper cavity portion 32 of the body 30.

Figure 3:
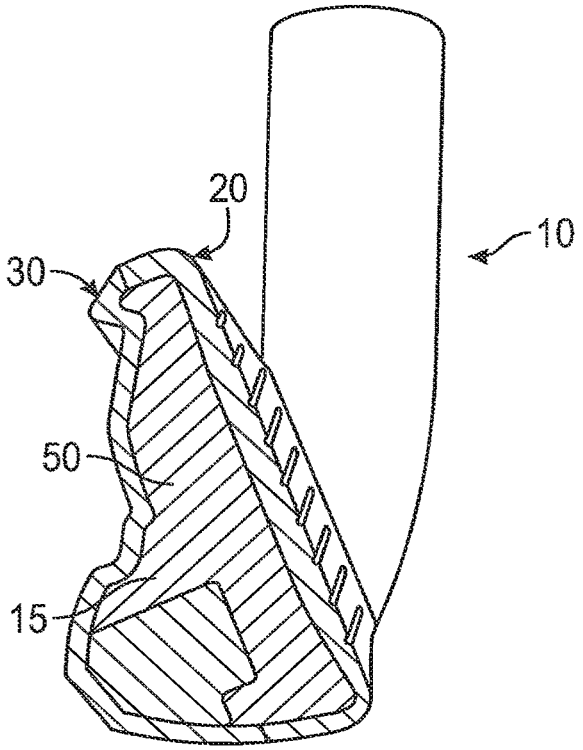
FIG. 3 is a cross-sectional view of a second embodiment of the present invention.

In an alternative embodiment, shown in FIG. 3, the golf club head 10 is a closed cavity back iron with a hollow interior 15, which is completely filled with the microscopic bubble fill material 50.

Figure 4:
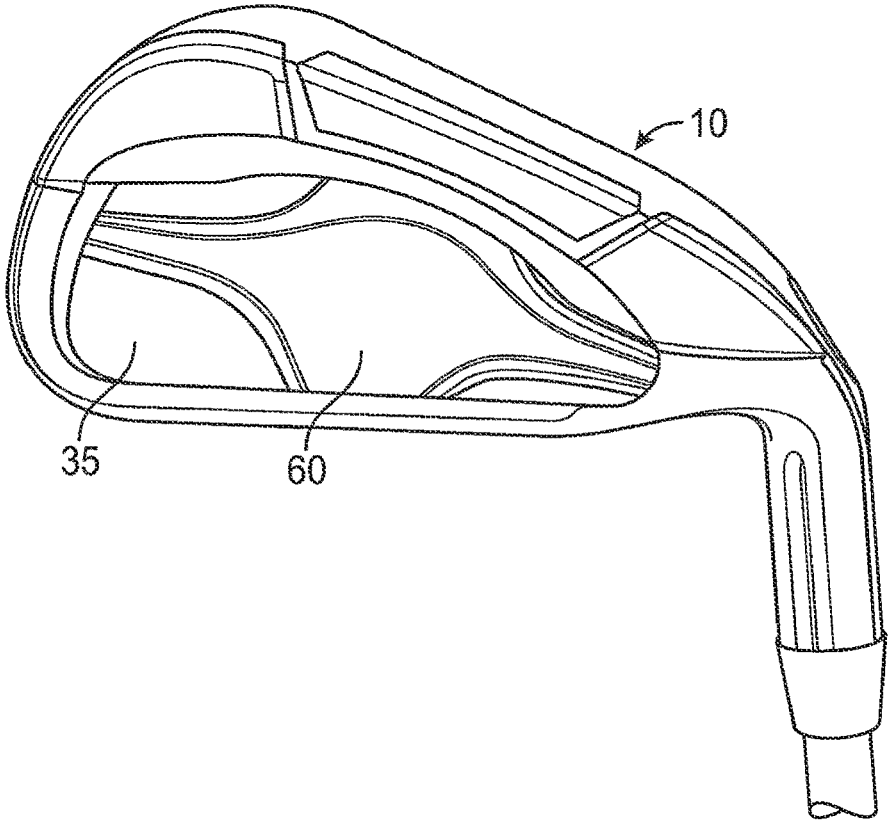
FIG. 4 is a rear elevational view of a third embodiment of the present invention.

In yet another embodiment, shown in FIG. 4, the golf club head 10 has an open cavity back 35 with a medallion 60 molded or otherwise formed from the microscopic bubble fill material 50 affixed to a rear surface 23 of the striking portion 22. When the microscopic bubble fill material 50 is incorporated into a medallion 60, it is preferably placed onto a back side of an electroformed medallion and permitted to cure, and then an adhesive is placed on the fill material 50 and used to bond the medallion 60 onto the club head 10.

In each of the embodiments disclosed herein, the microscopic bubbles in the novel fill material 50 preferably constitute 5% to 70% by volume of the fill material 50, more preferably at least 20% of the volume, and most preferably approximately 25-30% of the fill material's 50 volume.

Figure 5:
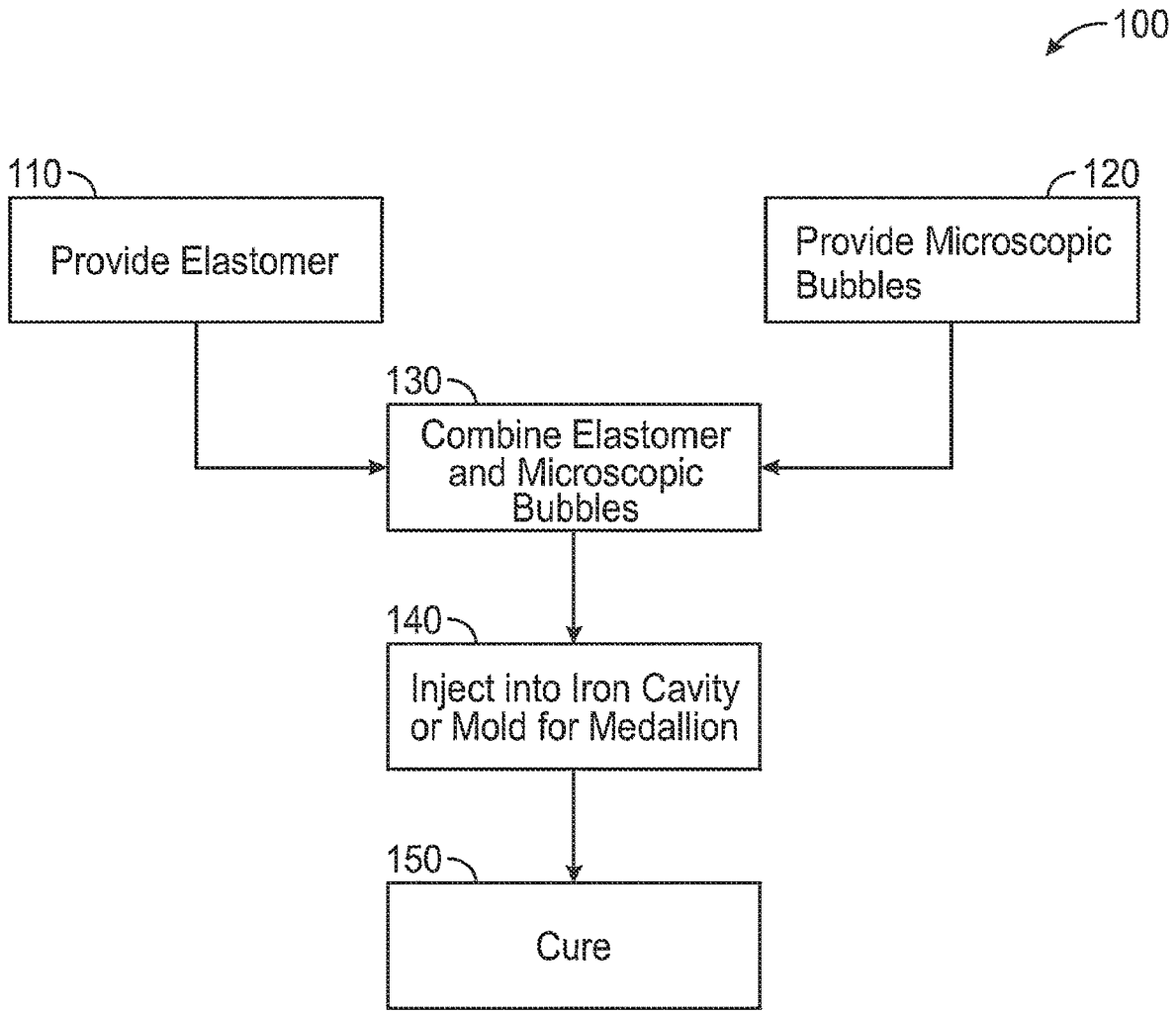
FIG. 5 is a flow chart illustrating a first method of preparing the polymer fill material shown in FIGS. 2-4.

There are several methods of manufacturing the microscopic bubble fill material 50 and incorporating it into the golf club head 10 according to the present invention. The first method 100, shown in FIG. 5, comprises the steps of providing an elastomer material 110 such as polyurethane, providing microscopic bubbles 120, combining the microscopic bubbles with the elastomer material 130 so that the microscopic bubbles form 5-70% of the volume of the resulting mixture, and more preferably approximately 25-30% of the volume of the resulting material, injecting the resulting mixture into a cavity 40 or hollow interior 15 of the golf club head, or a mold for a medallion 140, and then oven curing the mixture or otherwise allowing it to cure 150 (e.g., at air temperature for self-curing materials).

Figure 6:
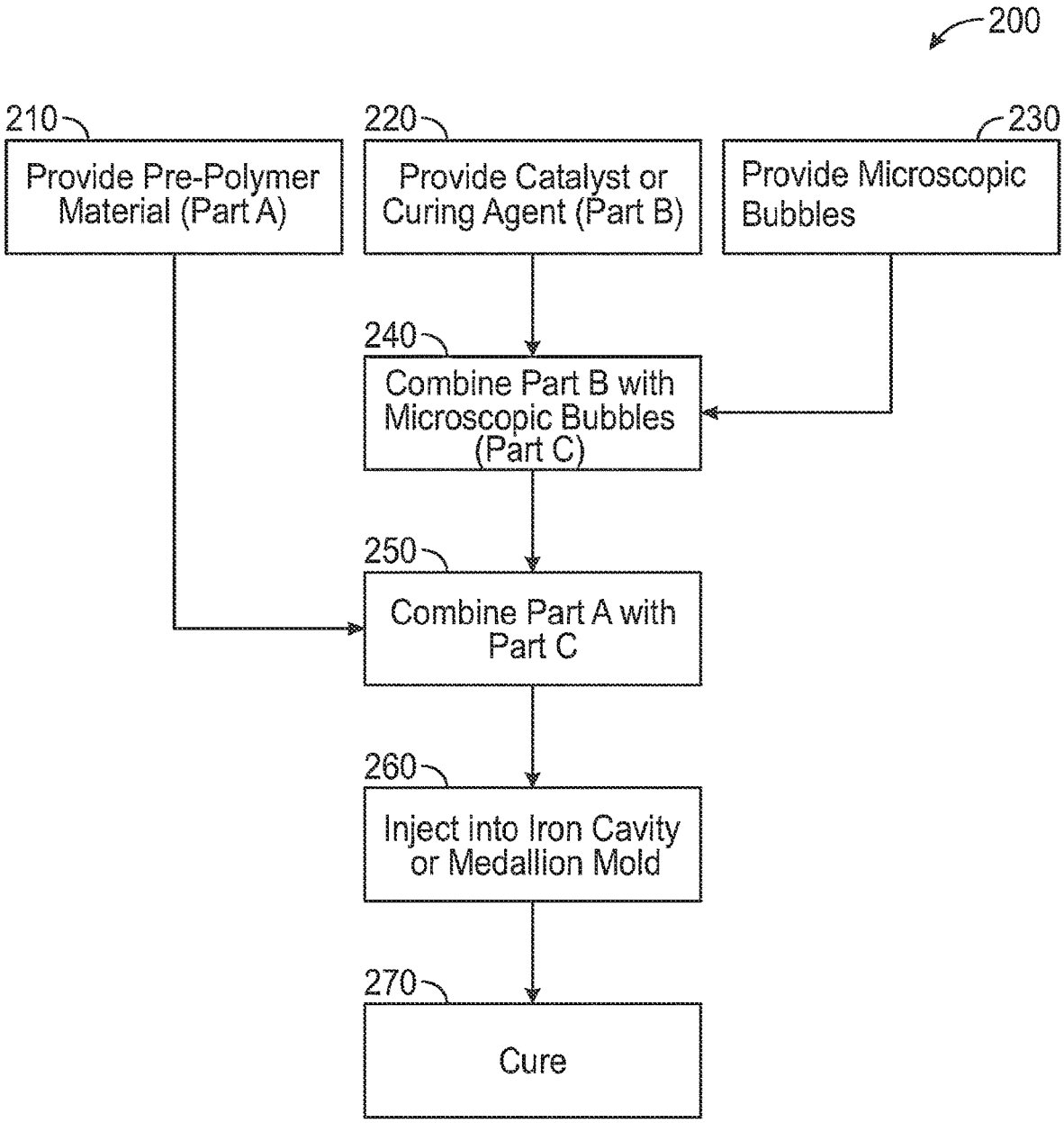
FIG. 6 is a flow chart illustrating a second method of preparing the polymer fill material shown in FIGS. 2-4.

The second, preferred method 200, shown in FIG. 6, comprises the steps of providing a pre-polymer resin (Part A) 210 such as a polyurethane or silicone, providing a curing or catalyst agent (Part B) 220, and providing the microscopic bubbles 230, combining the curing or catalyst agent (Part B) with the microscopic bubbles to form an intermediary material (Part C) 240 that is 5-70% by volume of microscopic bubbles, and more preferably 25-30% by volume, combining the intermediary material (Part C) with the polymer resin (Part A) 250, preferably in a 1:1 Part A to Part B ratio, to form a final mixture, injecting the final mixture into a cavity 40 or hollow interior 15 of the golf club head, or a mold for a medallion 260, and then oven curing the mixture or otherwise allowing it to cure 270. The benefit of this method 200 is that the intermediary material (Part C) can be prepared and placed into storage until a manufacturer is ready to catalyze the pre-polymer resin.

Figure 7:
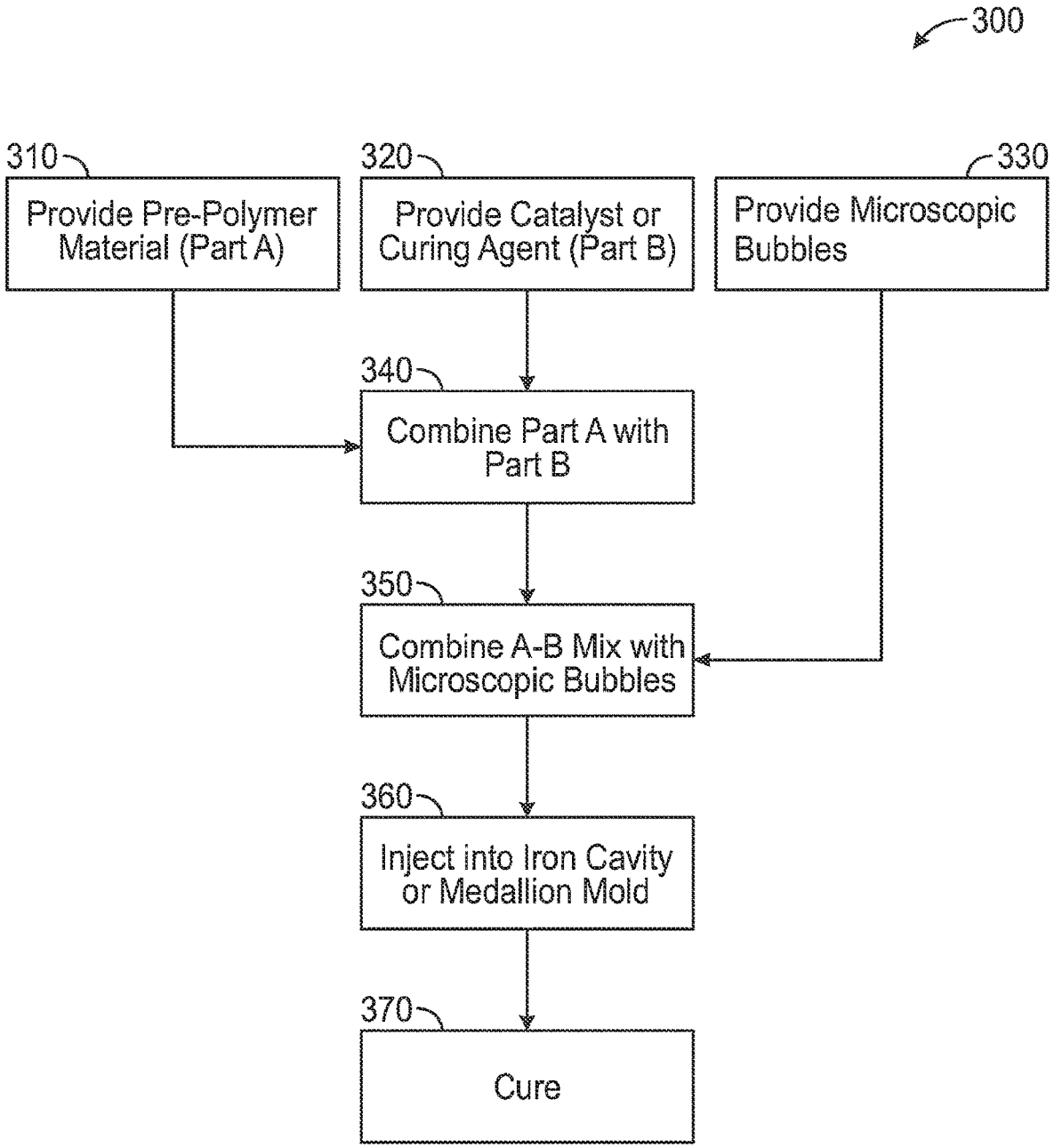
FIG. 7 is a flow chart illustrating a third method of preparing the polymer fill material shown in FIGS. 2-4.

The third method of the present invention is shown in FIG. 7. This method 300 comprises the steps of providing a pre-polymer resin (Part A) 310 (preferably polyurethane or silicone), providing a curing or catalyst agent (Part B) 320, and providing the microscopic bubbles 330, combining the polymer resin (Part A) with the curing or catalyst agent (Part B) 340, preferably in a 1:1 Part A to Part B ratio, to form an intermediary material, combining the intermediary material with microscopic bubbles 350 so that the microscopic bubbles are 5-70% of the volume of the resulting material, and more preferably 25-30% of the volume, injecting the resulting material into a cavity 40 or hollow interior 15 of the golf club head, or a mold for a medallion 360, and then oven curing the mixture or otherwise allowing it to cure 370.

In order to assess the COR performance of the inventive material, test iron-type golf club heads 10 having unfilled (empty) cavities were created and tested, and compared against golf club heads 10 having the same construction and filled with (1) the novel microscopic bubble fill material 50 comprising polyurethane and glass bubbles and made using one of the second 200 and third methods 300 and (2) polyurethane only. As shown in Tables 1 and 2, the polyurethane-only fill significantly lowers the COR of the golf club head 10. In contrast, when a golf club head cavity is filled with the microscopic bubble fill material 50 (glass) of the present invention, the COR decreases, on average, only by 0.04, thereby retaining the performance benefits of an unfilled golf club head 10. This is particularly evident when the microscopic bubbles or hollow microscopic beads constitute approximately 25% or 30% of the volume of the fill material 50, as shown in Table 1.

TABLE 1

| Test Club No. | COR (no fill) | COR (polyurethane only) | Change in COR |
|---|---|---|---|
| 1. | 0.827 | 0.806 | −0.021 |
| 2. | 0.827 | 0.806 | −0.021 |
| 3. | 0.824 | 0.812 | −0.012 |
| 4. | 0.818 | 0.796 | −0.022 |
| 5. | 0.813 | 0.793 | −0.020 |
| | Average change in COR | | −0.019 |
| **Test Club No.** | **COR (no fill)** | **COR (30% glass bubble fill)** | |
| 6. | 0.825 | 0.820 | −0.005 |
| 7. | 0.823 | 0.818 | −0.005 |
| 8. | 0.826 | 0.821 | −0.005 |

TABLE 1-continued

| | | | |
|---|---|---|---|
| 9. | 0.825 | 0.821 | −0.004 |
| 10. | 0.826 | 0.823 | −0.003 |
| 11. | 0.825 | 0.823 | −0.002 |
| 12. | 0.823 | 0.817 | −0.006 |
| 13. | 0.821 | 0.817 | −0.004 |
| 14. | 0.818 | 0.816 | −0.002 |
| 15. | 0.816 | 0.813 | −0.003 |
| 16. | 0.825 | 0.821 | −0.004 |
| 17. | 0.825 | 0.817 | −0.008 |
| Test Club No. | COR (no fill) | COR (25% glass bubble fill) | |
| 18. | 0.824 | 0.821 | −0.003 |
| 21. | 0.823 | 0.817 | −0.006 |
| | Average change in COR | | −0.004 |

TABLE 2

| Test Club No. | COR (no fill) | COR (polyurethane only) | Change in COR |
|---|---|---|---|
| 1. | 0.813 | 0.793 | −0.20 |
| Test Club No. | COR (no fill) | COR (5% glass bubble fill) | Change in COR |
| 2. | 0.815 | 0.804 | −0.11 |

Figure 8:
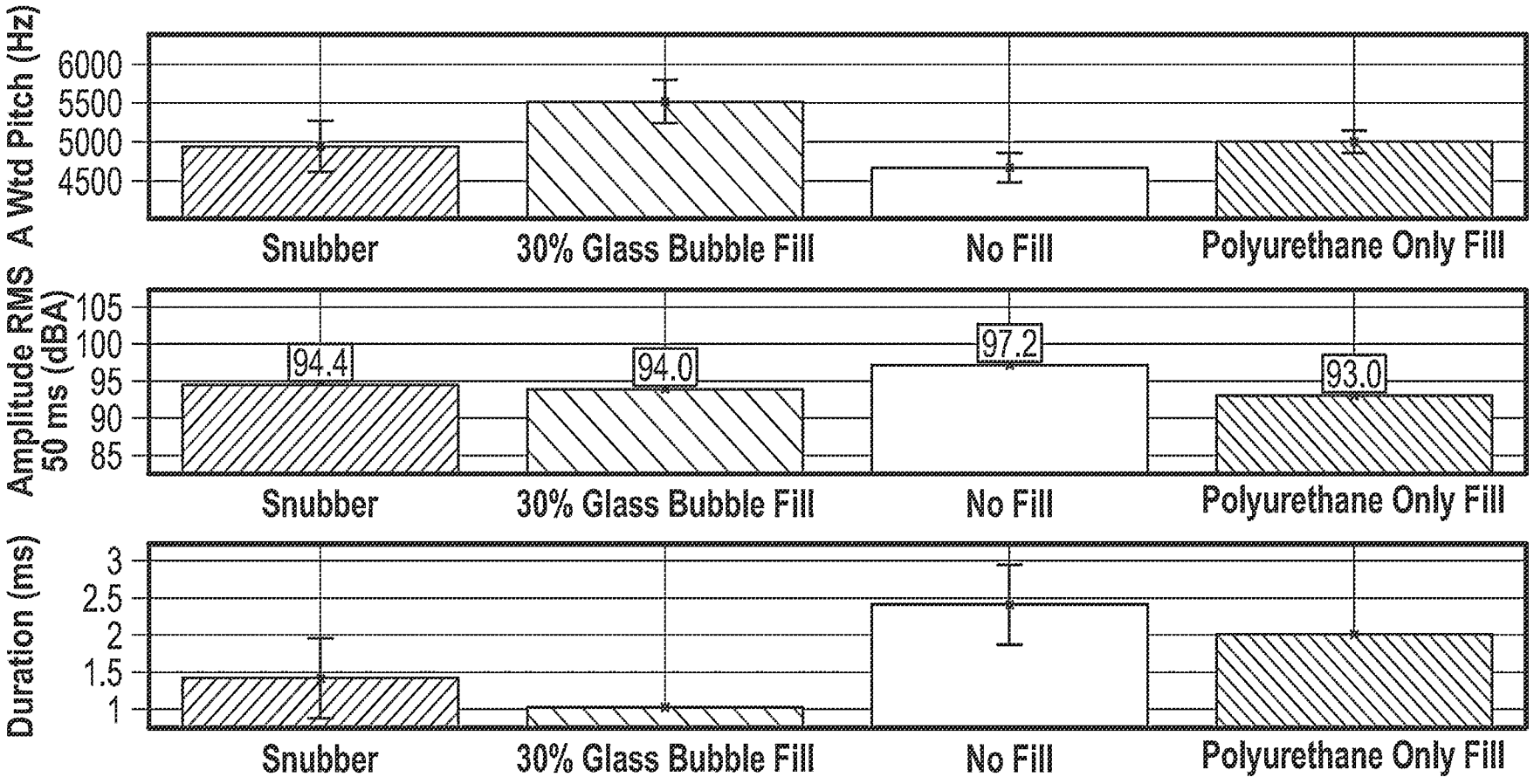
FIGS. 8-9 are charts showing sound measurements of the golf club head shown in FIG. 1 with and without different polymer fill materials and configurations.
Figure 9:
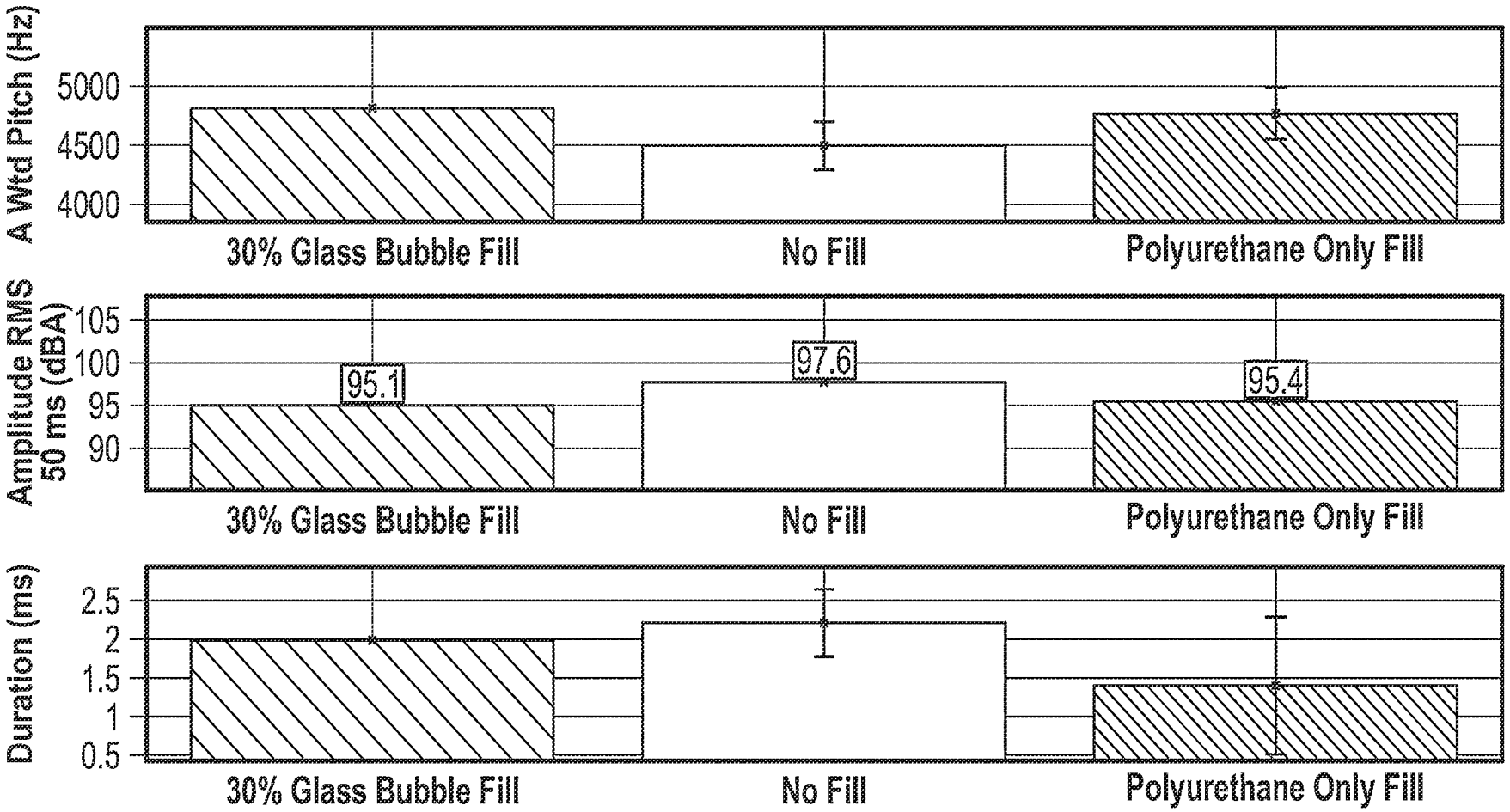

In order to assess sound performance, another group of test golf club heads 10 incorporating the 30% by volume novel microscopic bubble fill material 50 comprising polyurethane and glass bubbles, and made using one of the second 200 and third methods 300 were tested and compared with golf club heads 10 having: (1) the same construction and filled with only polyurethane; (2) no polyurethane filler at all; and (3) a small polyurethane snubber insert. As shown in FIGS. 8 and 9, the 30% by volume microscopic bubble fill material 50 improves the pitch and amplitude of the golf club head 10 upon impact with a golf ball compared to a polyurethane-only fill, thereby improving the overall sound of the golf club head 10. Preferably, a golf club head 10 incorporating the novel fill material has a pitch upon impact with a golf ball of 3000-6000 Hz, and more preferably of 4500-6000 Hz, an amplitude of 90-100 dB, and a duration of 1.0-2.5 ms.

Figure 10:
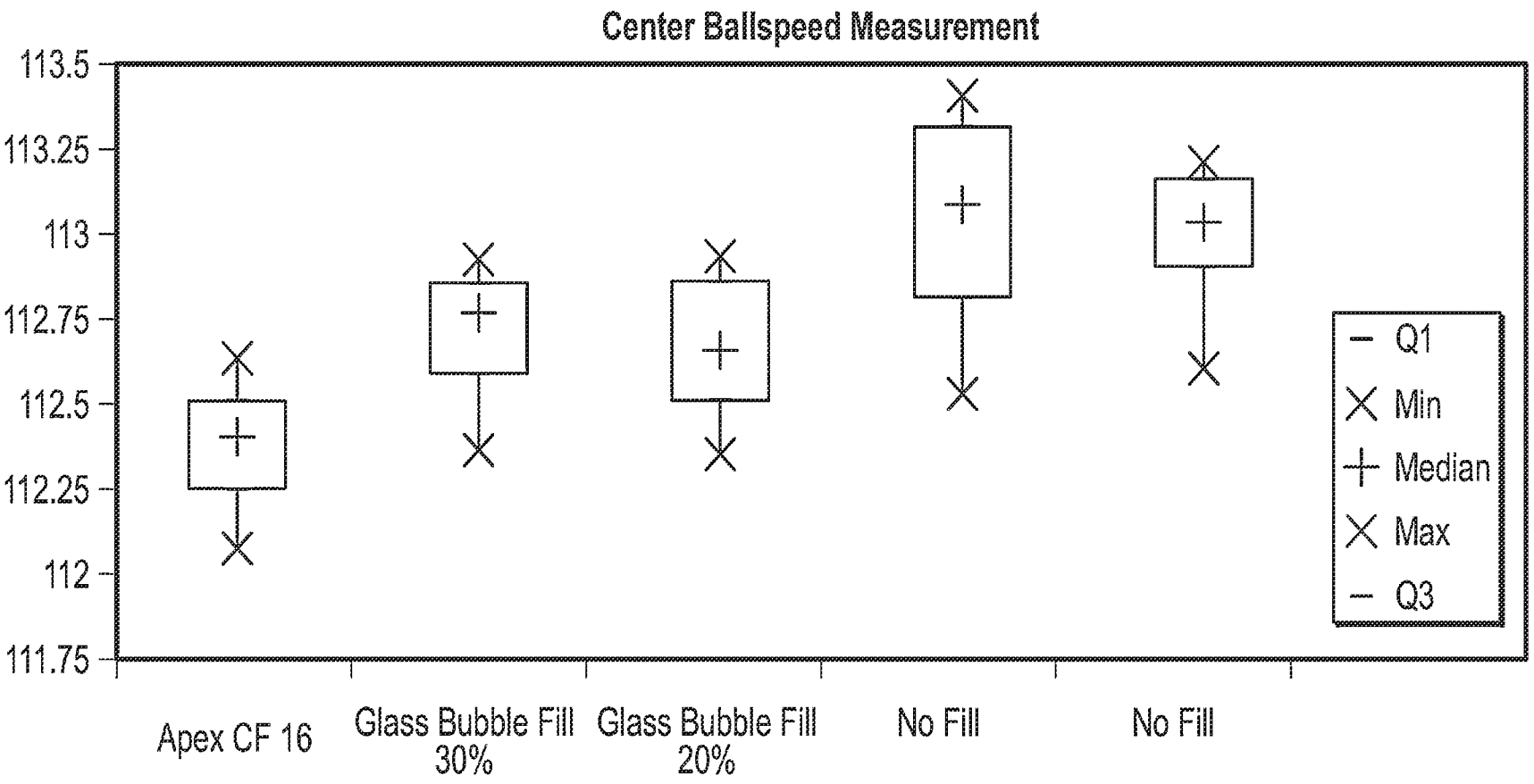
FIG. 10 is a box plot showing ball speed measurements taken from a central area of the face of test 6 iron heads having different polymer fill materials and configurations.
Figure 11:
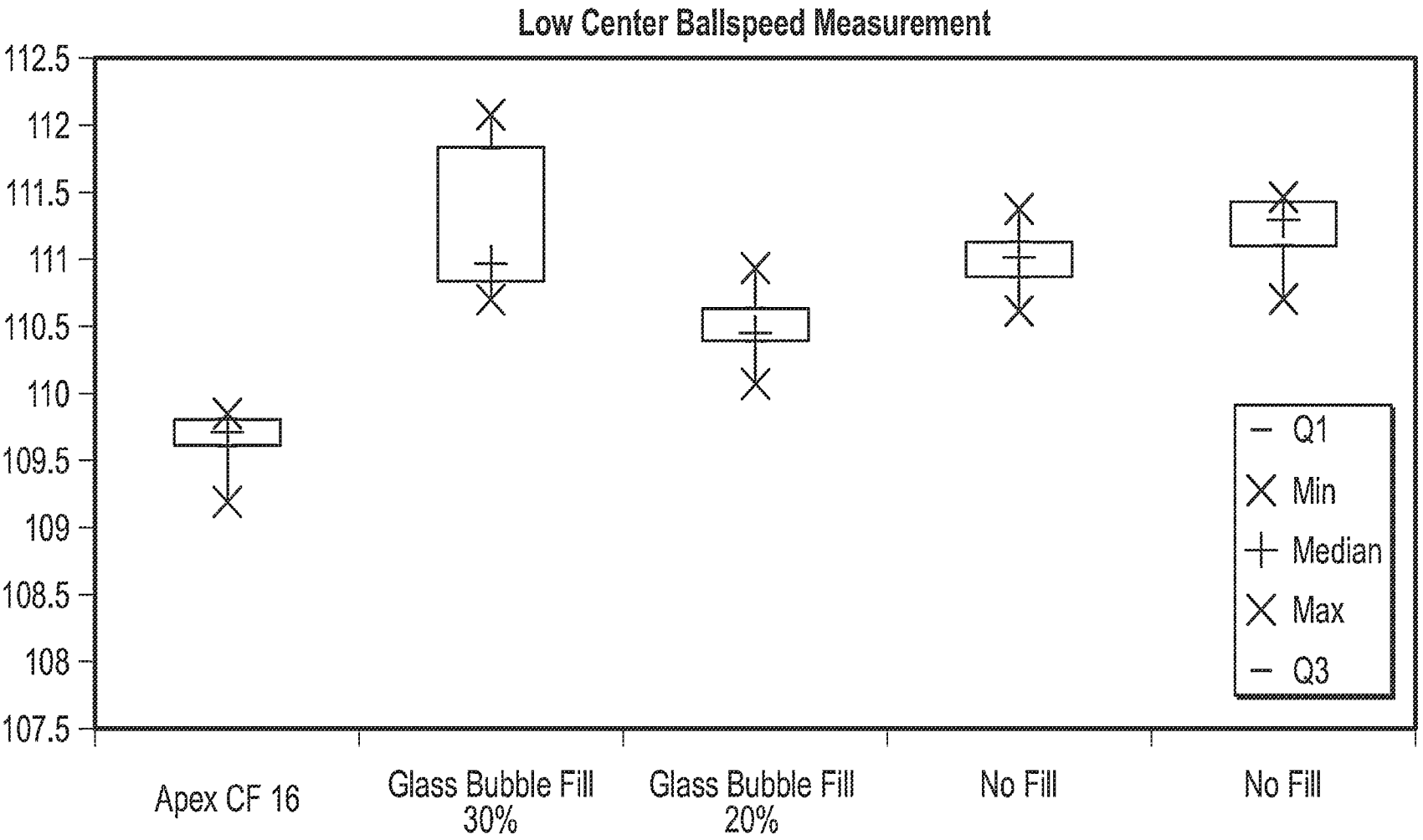
FIG. 11 is a box plot showing ball speed measurements taken from a low-central area of the face of test 6 iron heads having different polymer fill materials and configurations.

To assess the effects of the novel fill material on ball speed performance, the performance of a Callaway Golf Apex CF 16 6-iron comprising a small polymeric snubber was compared with the performance of test 6-irons having no fill, test 6-irons with a fill having 30% by volume microscopic bubbles (glass material), and test 6-irons with a fill having 20% by volume microscopic bubbles (glass material). As shown in FIGS. 10 and 11, the test irons comprising the novel, microscopic bubble fill had a higher median ball speed measured at both the center and low center of the striking face compared with the Apex CF 16 6-iron, and approached or surpassed the ball speed of test clubs lacking a fill material.

Figure 12:
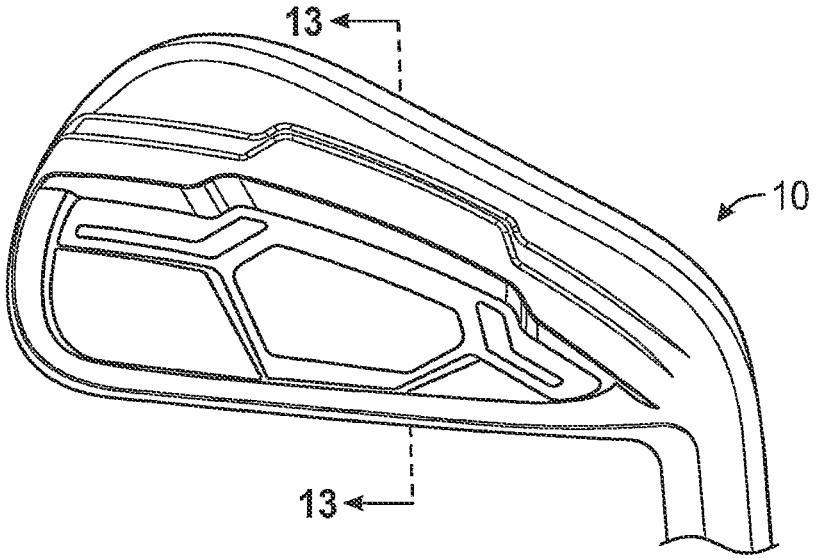
FIG. 12 is a rear elevational view of a fourth embodiment of the present invention.
Figure 13:
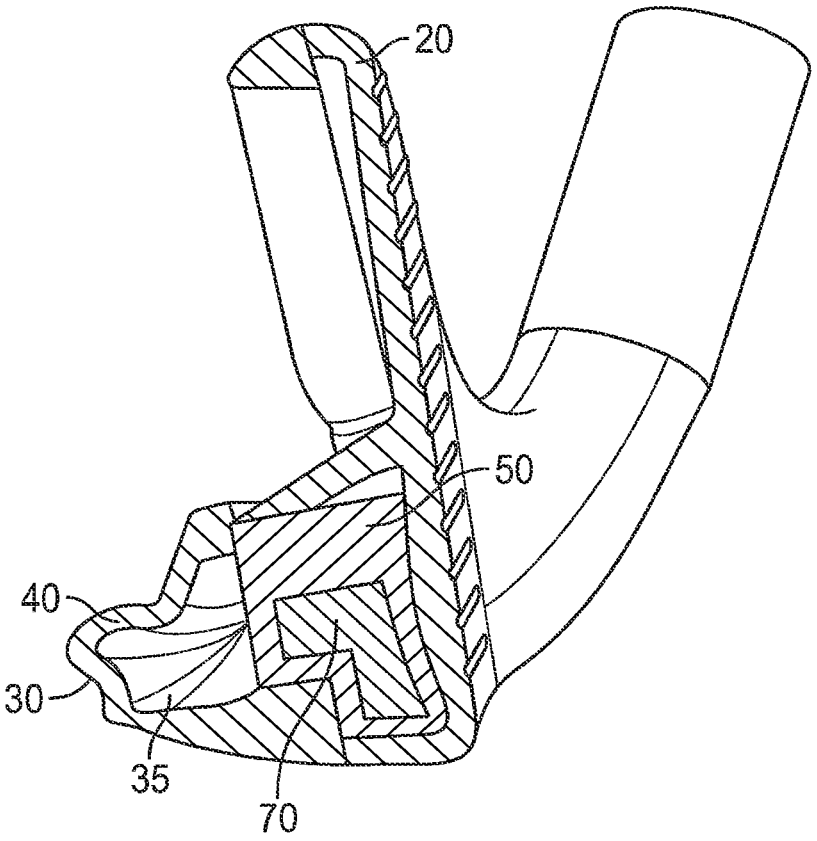
FIG. 13 is a cross-sectional view of the embodiment shown in FIG. 12 along lines 13-13.

In yet another embodiment of the present invention, shown in FIGS. 12 and 13, the golf club head 10 has many of the same features as the embodiments shown in FIGS. 1-3, except that the cavity 40 extends further into a rear portion 35 of the body 30 of the golf club head 10, and the golf club head 10 includes a weight 70 sized to fit within at least a portion of the cavity 40. The weight 70, which preferably is composed of a metal alloy material having a density of 4 g/cc or greater, such as steel or tungsten alloy, is over-molded with the novel fill material 50 of the present invention, which preferably completely envelops the weight 70 and at least partially fills the cavity 40 of the golf club head 10. This embodiment serves to move mass downwards and towards the striking portion 22 of the face cup 20 without compromising the COR of the golf club head 10.

Figure 14:
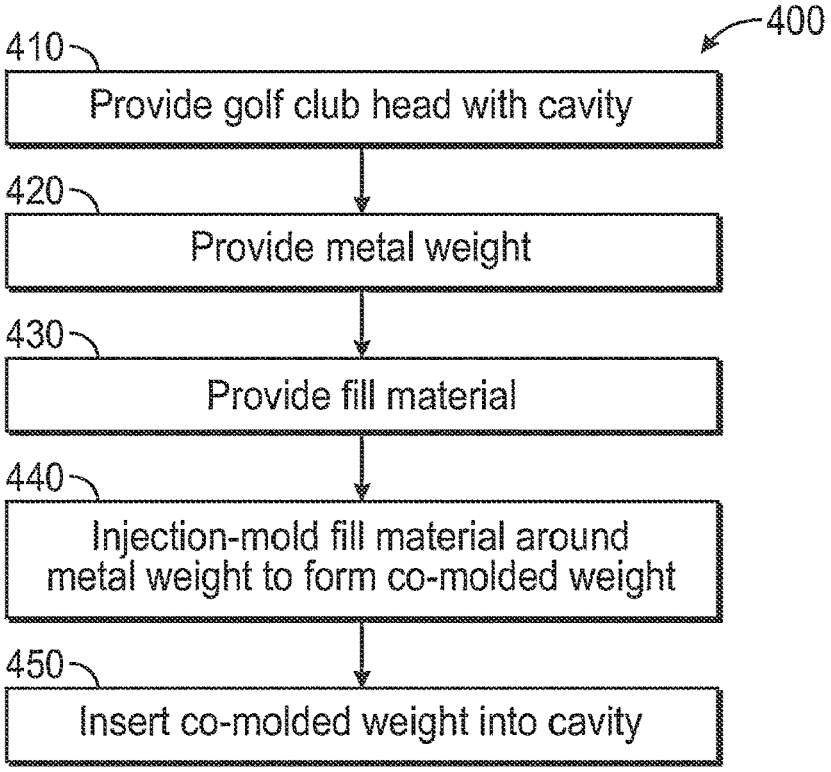
FIG. 14 is a flow chart illustrating a first method of preparing the golf club head shown in FIGS. 12-13.
Figure 15:
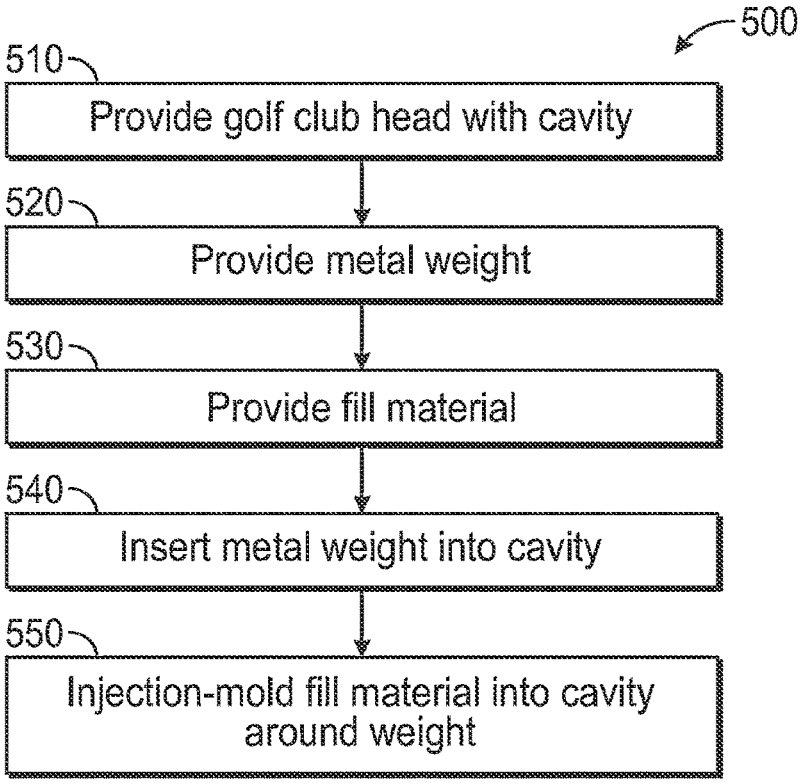
FIG. 15 is a flow chart illustrating a second method of preparing the golf club head shown in FIGS. 12-13.

The embodiment shown in FIGS. 12-13 can be achieved via several methods. A first method 400, shown in FIG. 14, comprises the steps of providing a golf club head comprising a body having a cavity 410, providing a metal weight 420, providing a fill material 50 comprising a polymer material and a plurality of microscopic bubbles composed of a low-density material 430, injection-molding the fill material onto the metal weight to create a co-molded weight 440, and inserting the co-molded weight into the cavity 450. An alternative method 500, shown in FIG. 15, comprises the steps of providing a golf club head comprising a body having a cavity 510, providing a metal weight 520, providing a fill material 50 comprising a polymer material and a plurality of microscopic bubbles composed of a low-density material 530, inserting the metal weight into the cavity 540, and injection-molding the fill material into the cavity and around at least a portion of the metal weight 550. Each of these methods produces a golf club head having a low center of gravity and an optimized COR.

Figure 16:
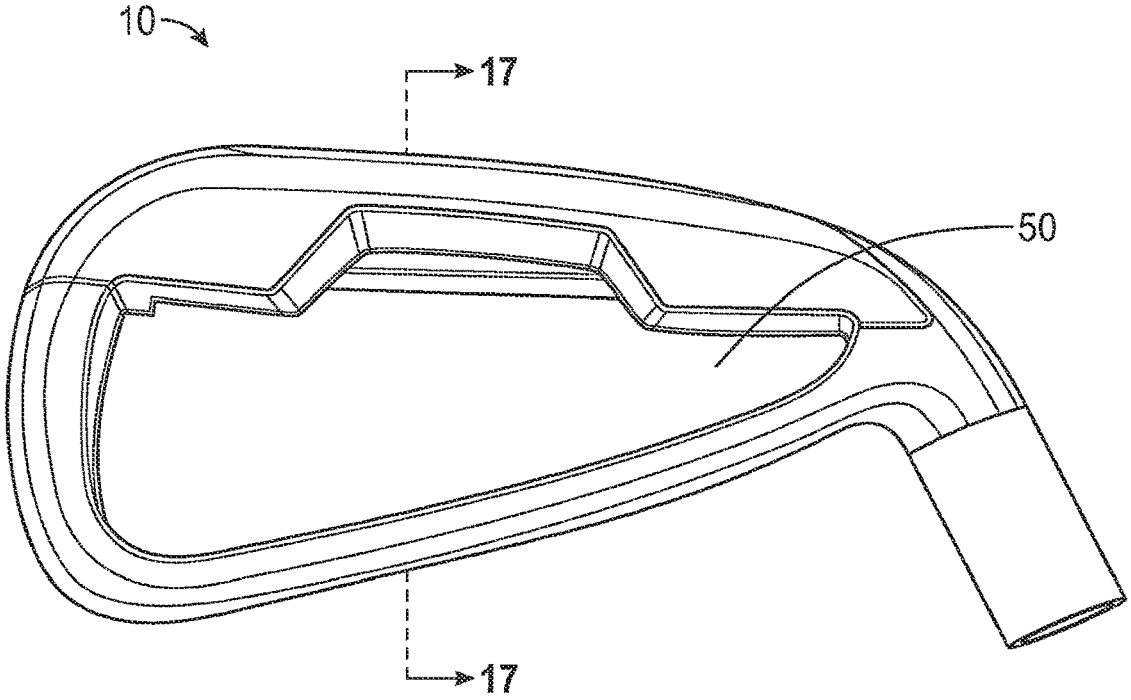
FIG. 16 is a rear elevational view of a fifth embodiment of the present invention.
Figure 17:
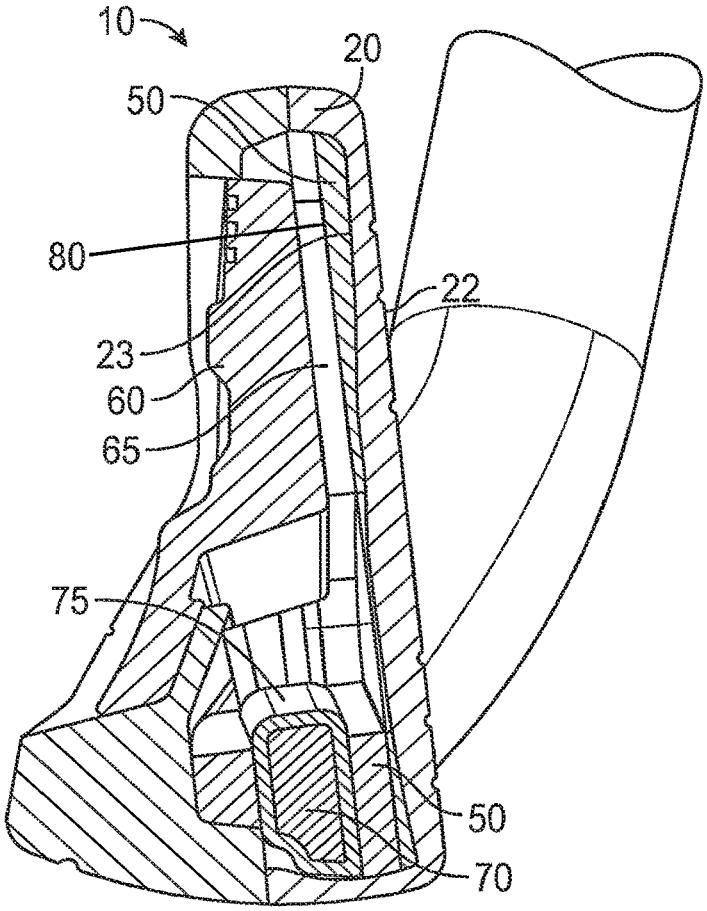
FIG. 17 is a cross-sectional view of the embodiment shown in FIG. 16 along lines 17-17.

In a preferred embodiment, shown in FIGS. 16-17, the face portion 26 of the face cup 20 has a variable thickness, with the striking portion 22 being planar and the rear surface 23 having a topography reflecting the variable thickness pattern. The variable thickness pattern improves the striking performance of the face cup 20, but complicates the process of adding a medallion 60 to the rear surface 23. As shown in FIGS. 16 and 17, the golf club head 10 comprises a thin layer of the fill material 50 coating the rear surface 23, which creates a flat or planar surface 80. The medallion 60 is then affixed to the planar surface 80 with an adhesive material 65. The embodiment shown in FIGS. 16-17 also includes a weight 70, which is enveloped in a first overmold material 75 and is secured within the cavity 40 with the fill material 50 of the present invention. This feature may be provided using the method illustrated in FIG. 15.

Figure 18:
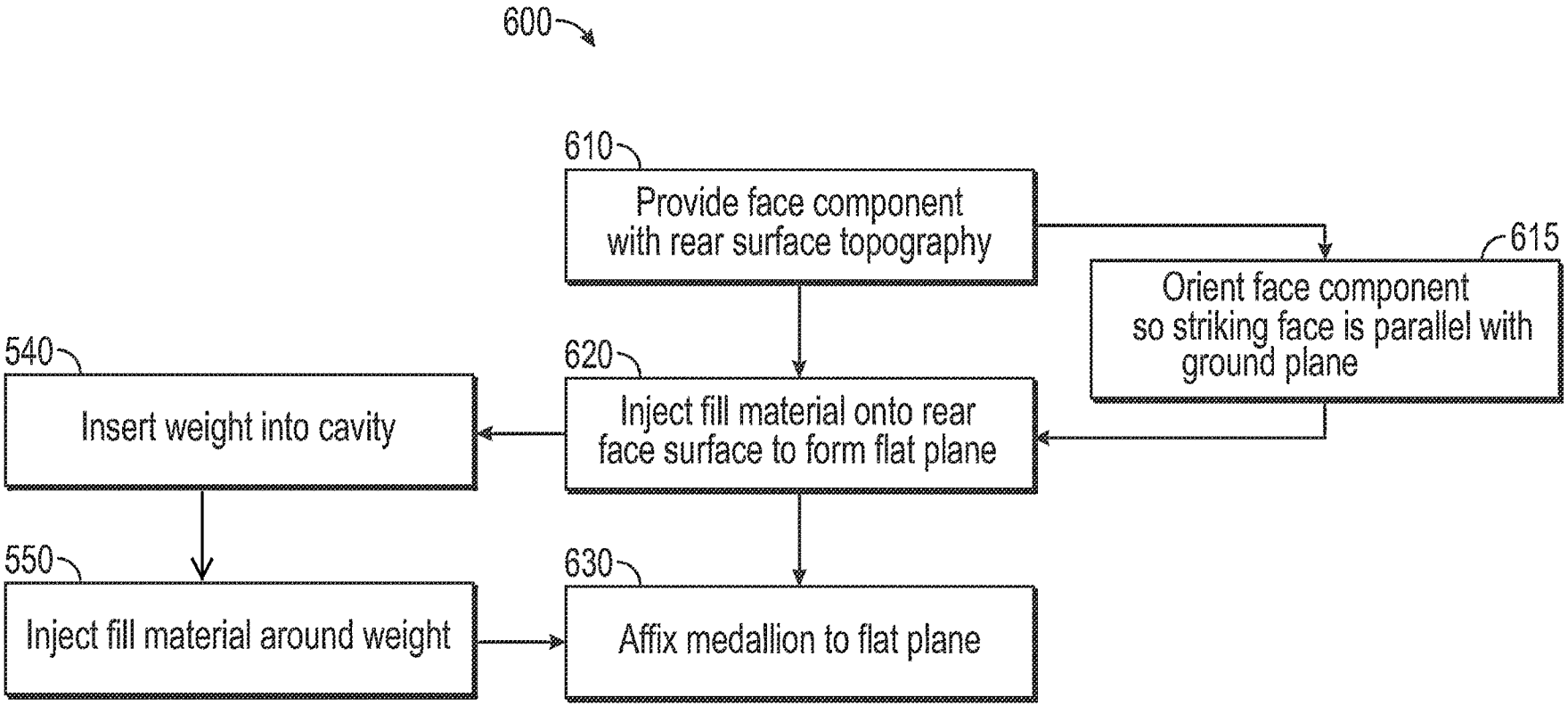
FIG. 18 is a flow chart illustrating a method of preparing the golf club head shown in FIGS. 16-17.

A method of manufacturing the preferred embodiment is illustrated in FIG. 18. This method 600 includes a first step 610 of providing a golf club face component or face cup 20 having a variable thickness striking portion 22 with a rear surface 23 topography; a second step 620 of injecting the fill material 50 onto the rear surface 23 of the striking portion 22 to form a flat, planar surface 80, and a third step 630 of affixing a medallion 60 to the planar surface 80 630. The second step 620 preferably is performed when the face cup 20 is oriented so that the striking portion 22 is parallel with a ground plane, which is illustrated in FIG. 18 as step number 615. In this orientation, the fill material 50 free flows onto the rear surface 23 and becomes self-leveling until the fill material 50 reaches its gel state.

Figure 19:
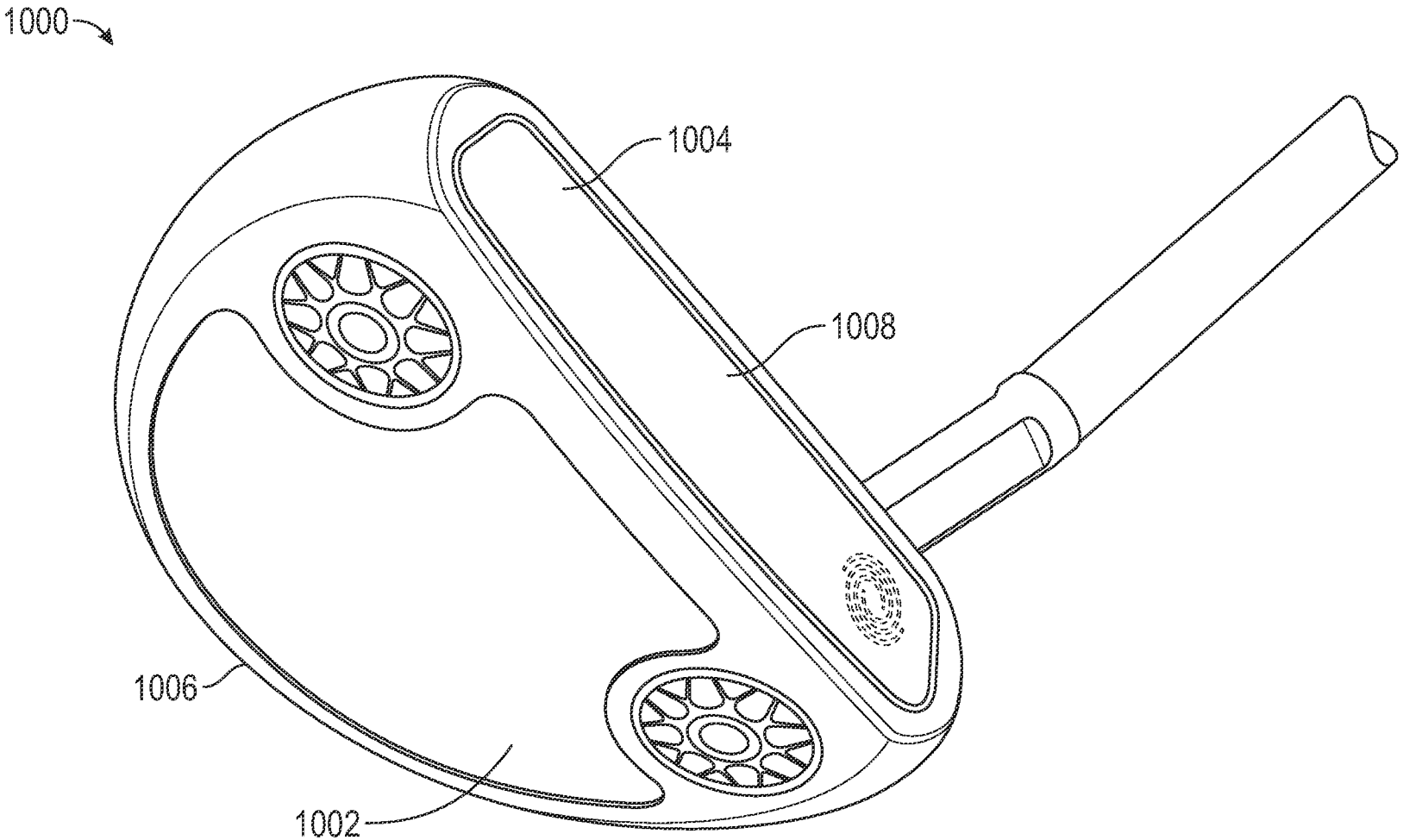
FIG. 19 is a front bottom perspective view of a golf club putter head with a putter insert.

With reference to FIG. 19, an exemplar golf club putter head 1000 is shown. The golf club putter head 1000 illustrated is exemplary, and it will be understood that putter heads come in many different shapes, sizes and configurations. The golf club putter head 1000 includes a body 1002 with a striking face 1004 and a rear portion 1006. The striking face 1004 includes a cavity (not shown) into which is affixed a putter insert 1008.

Putters have used face inserts for many years to provide an enhanced feel after striking the golf ball. Putter inserts can be made from many different types of materials, depending on the "feel" that a player desires, and the intended cost of the putter. When an putter insert is comprised of a softer material than the metal body of the putter head, the softer material provides more compression between the ball and the club than would be possible with a metal striking face, thus giving the player a softer "feel" and in many cases, more control over the golf shot. Two main methods of producing plastic face inserts exist in the marketplace, specifically injection molding and casting. An advantage of using a cast urethane material to create a putter face insert is that no hard mold tooling is required. Instead, many unique shapes can be cut out of a sheet of cast urethane by using cutting tools such as wire cutting devices, laser cutting machines or waterjet cutting machines. Further, this approach enables a manufacturer to more easily achieve a desired fit of the insert in the striking face cavity of the putter head.

A cast urethane putter insert has been used in certain of the Odyssey® series of putters by Applicant for many years, and this cast urethane putter insert is desired by consumers for its iconic "feel". This "feel" is achieved by the material hardness, bounce back of the plastic and the thickness of the putter insert.

Embodiments disclosed herein improve on a major shortcoming of the current casting process for a urethane putter insert by adding microspheres (either one type, or multiple types) to the urethane, to provide more favorable feel, sound, or/and performance. The microsphere compounds of both solid and hollow glass and ceramics can help reduce the volume of urethane needed within face insert to reduce material cost while maintaining or even enhancing feel, sound and/or performance.

The compression of ceramics when compared to plastic is significantly less and this difference in material composition will help improve the rigidity of the putter insert without changing the hardness of the physical urethane. The benefit of this could be that the player "feels" the same stroke as a conventional cast urethane putter insert, but for example, because of ceramic microspheres, the insert would have a more rigid surface resulting in improvement to ball speed.

In accordance the disclosure herein, the putter insert 1008 is a cured polymer with some quantity of microspheres distributed in the cured polymer. It is believed by the Applicants that this composition of putter insert, including but not limited to the embodiments disclosed herein, can provide further advantages with respect to "feel", ball control, ball speed, sound, and performance, while reducing cost of materials and manufacture over other putter insert compositions. In one embodiment of the golf club putter head, the polymer is cast urethane. The microspheres may be many different types of microspheres, depending upon the effect desired. Some exemplary types of microspheres include glass, hollow glass, ceramic, and plastic. For example, ceramic microspheres referred to herein may include products made and sold by the 3M company, such as microspheres identified as W-210, W-410 and W-610. In another example, glass microspheres referred to herein may include products made and sold by the 3M company, such as microspheres identified as K, S, iM, XLD, Floated series and HGS Series.

Figure 20:
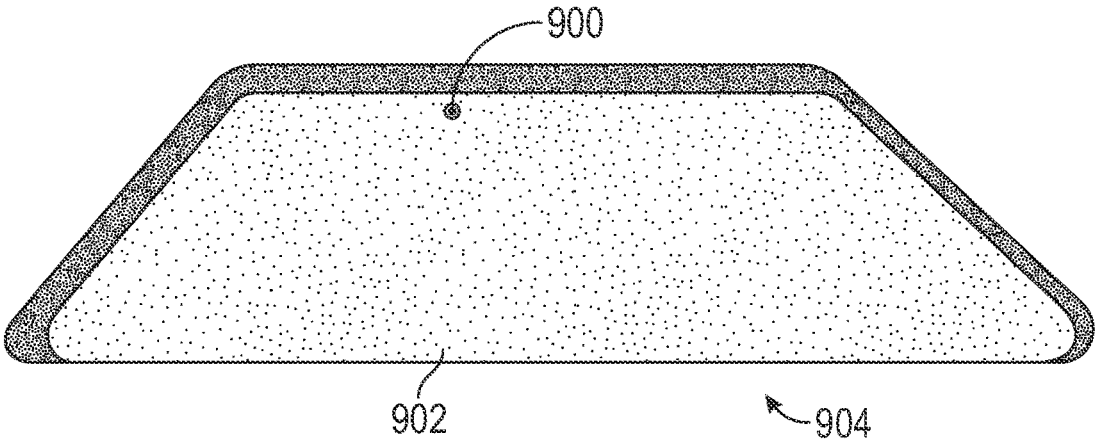
FIG. 20 is a schematic front perspective view of a putter insert in accordance with the present disclosure.

With reference to FIG. 20, in one embodiment, the microspheres 900 are uniformly distributed within the cured polymer 902, and thus are uniformly distributed throughout the putter insert 904. However, with reference to FIGS. 21-28, other embodiments have the microspheres non-uniformly distributed within the polymer, in order to achieve various different "feel" types preferred by different players, or to address and reduce the effect of certain common putting stroke errors.

Figure 21:
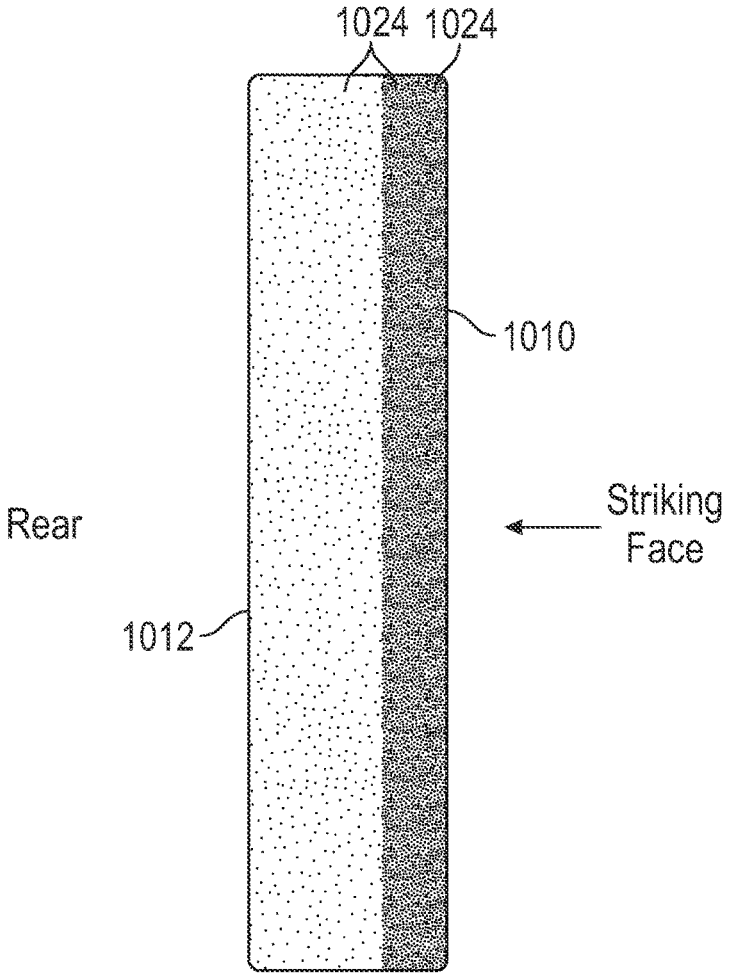
FIG. 21 is a schematic cross-sectional view of a second embodiment of the putter insert of the present disclosure.

With reference to FIG. 21, the golf club putter insert has a striking face side 1010 and a rear side 1012, and the plurality of microspheres 1014 are non-uniformly distributed within the polymer 1015, such that there is a greater density of microspheres at the striking face side 1010 than at the rear side 1012.

Figure 22:
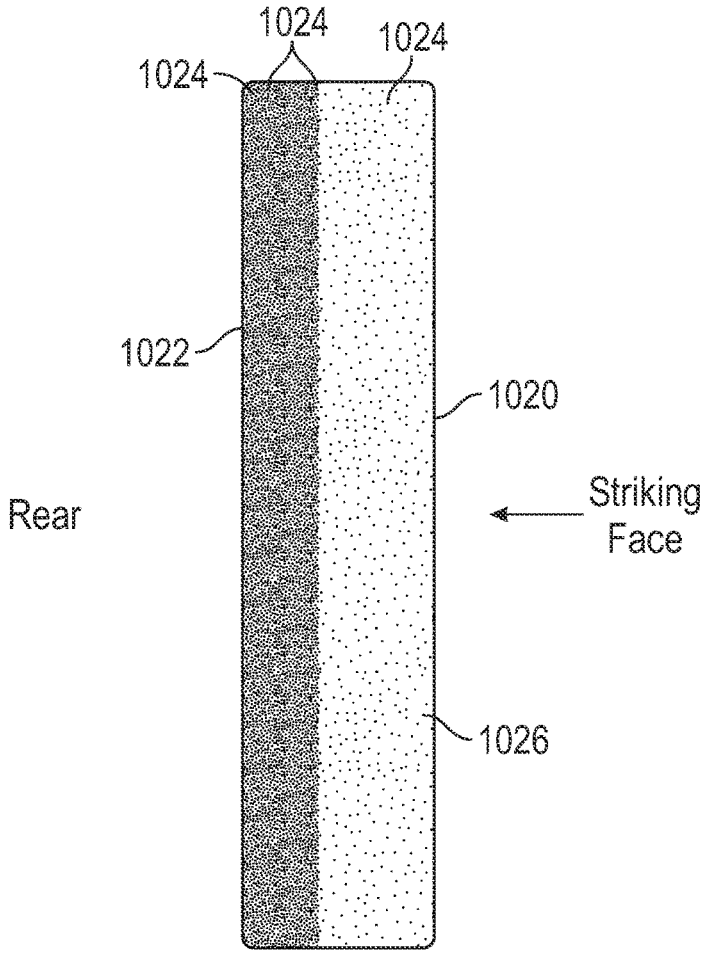
FIG. 22 is a schematic cross-sectional view of a third embodiment of the putter insert of the present disclosure.

With reference to FIG. 22, the golf club putter insert has a striking face side 1020 and a rear side 1022, and the plurality of microspheres 1024 are non-uniformly distributed within the polymer 1026, such that there is a greater density of microspheres at the rear side 1022 than at the striking face side 1020. This would provide a strong "backer" design similar to injection molded inserts with steel backer, but at a lower cost and reduced manufacturing complexity. This embodiment is also believed to provide rigidity to the insert without impacting the hardness of the material.

Figure 23:
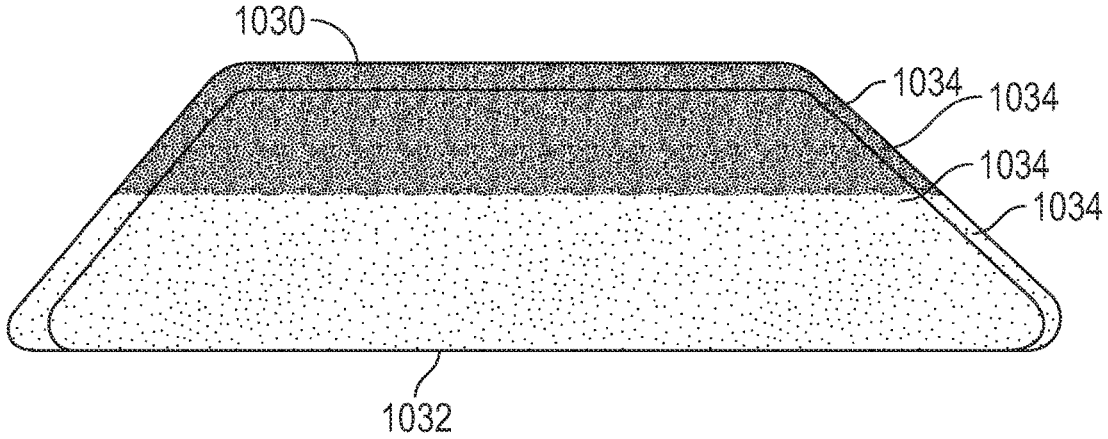
FIG. 23 is a schematic front perspective view of a fourth embodiment of the putter insert in accordance with the present disclosure.

With reference to FIG. 23, the golf club putter insert has a top edge 1030 and a sole edge 1032, and the plurality of microspheres 1034 are non-uniformly distributed within the polymer, such that there is a greater density of microspheres at the top edge 1030 than at the sole edge 1032.

Figure 24:
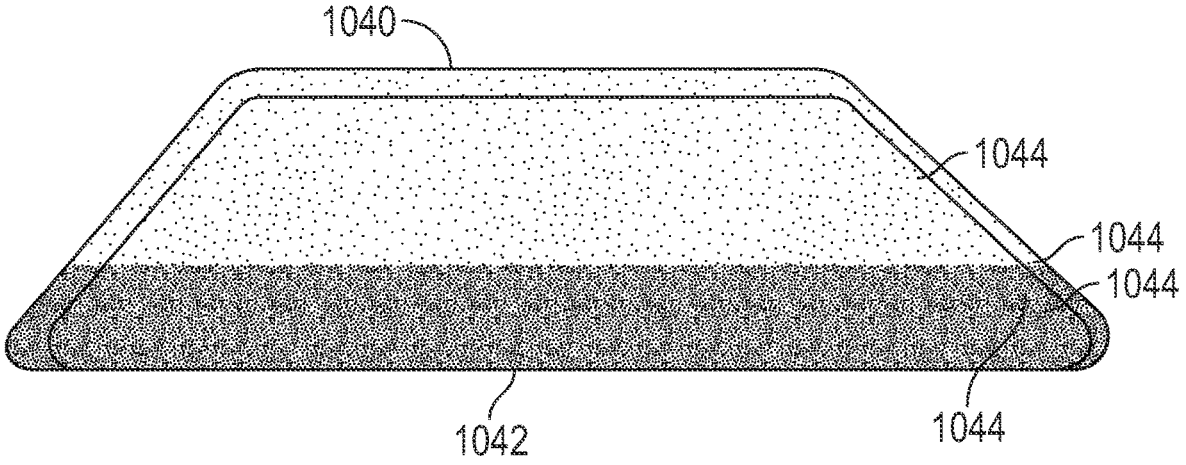
FIG. 24 is a schematic front perspective view of a fifth embodiment of the putter insert in accordance with the present disclosure.

With reference to FIG. 24, the golf club putter insert has a top edge 1040 and a sole edge 1042, and the plurality of microspheres 1044 are non-uniformly distributed within the polymer, such that there is a greater density of microspheres at the sole edge 1042 than at the top edge 1040.

Figure 25:
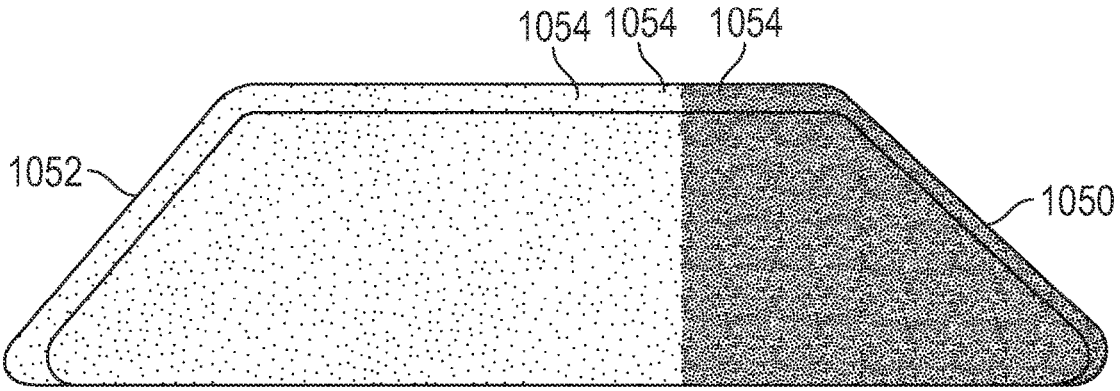
FIG. 25 is a schematic front perspective view of a sixth embodiment of the putter insert in accordance with the present disclosure.

With reference to FIG. 25, the golf club putter insert has a heel edge 1050 and a toe edge 1052, and the plurality of microspheres 1054 are non-uniformly distributed within the polymer, such that there is a greater density of microspheres at the heel edge 1050 than at the toe edge 1052.

Figure 26:
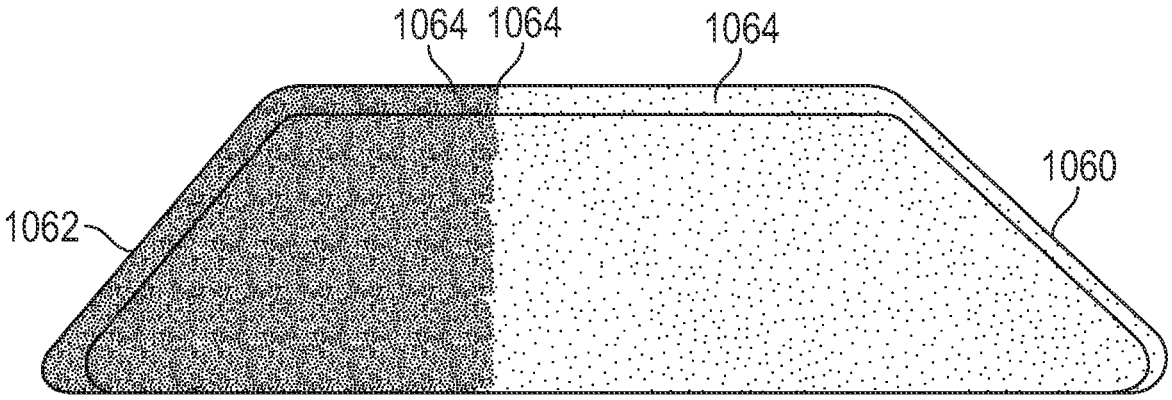
FIG. 26 is a schematic front perspective view of a seventh embodiment of the putter insert in accordance with the present disclosure.

With reference to FIG. 26, the golf club putter insert has a heel edge 1060 and a toe edge 1062, and the plurality of microspheres 1064 are non-uniformly distributed within the polymer, such that there is a greater density of microspheres at the toe edge 1062 than at the heel edge 1060.

Figure 27:
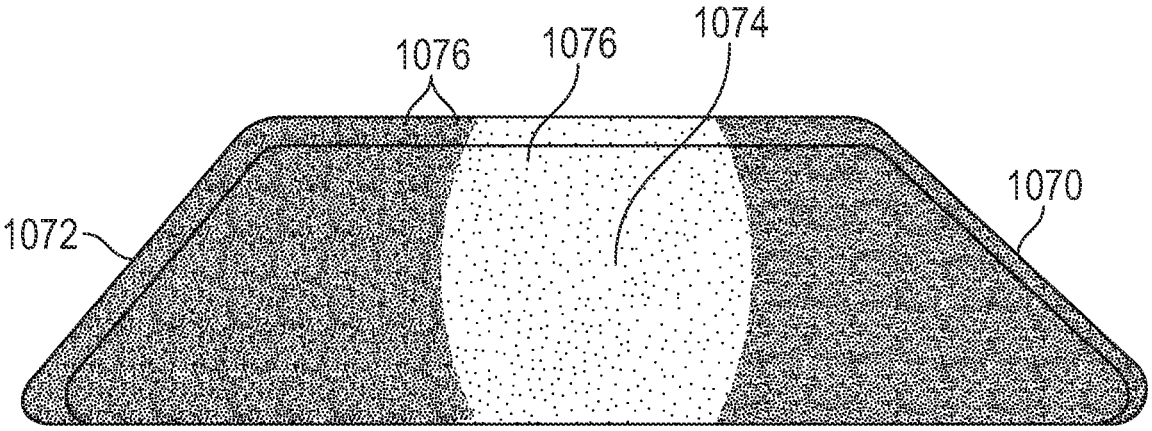
FIG. 27 is a schematic front perspective view of an eighth embodiment of the putter insert in accordance with the present disclosure.

With reference to FIG. 27, the golf club putter insert has a heel edge 1070, a toe edge 1072, and a center zone 1074, and the plurality of microspheres 1076 are non-uniformly distributed within the polymer, such that there is a greater density of microspheres at the toe edge 1070 and the heel edge 1072 than at the center zone 1074.

Figure 28:
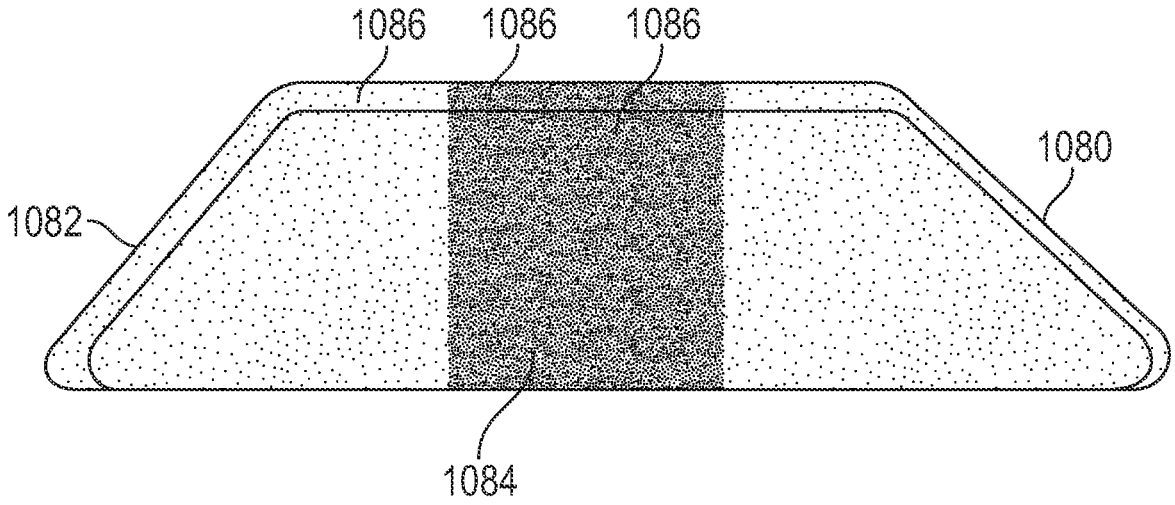
FIG. 28 is a schematic front perspective view of a ninth embodiment of the putter insert in accordance with the present disclosure.

With reference to FIG. 28, the golf club putter insert has a heel edge 1080, a toe edge 1082, and a center zone 1084, and the plurality of microspheres 1086 are non-uniformly distributed within the polymer, such that there is a greater density of microspheres at the center zone 1084 than at the toe edge 1082 and the heel edge 1080.

The golf club putter insert may have varying quantities and densities of microspheres. When compared to the polymer, the microspheres may comprise at least five percent of the insert, less than fifty percent, or between five and fifty percent, when measured on a weight-by-volume basis.

A variety of methods of manufacture of these embodiments follow from the desired distribution of, and the type of, microspheres used. In certain embodiments, microspheres that have a higher specific gravity than the liquid polymer will "sink" in the liquid polymer prior to curing. For example, solid ceramic microspheres generally have a higher specific gravity than liquid urethane, thus they will migrate downward over time due to the force of gravity if the urethane is left in liquid form for a period of time prior to curing. This difference in specific gravity may be utilized to control the distribution of microspheres in the finished cured putter insert, as desired. Likewise, microspheres that have a lower specific gravity than the polymer will tend to rise upward in the liquid polymer prior to curing. For example, hollow glass microspheres generally have a lower specific gravity than liquid urethane, thus they will migrate upward over time if the urethan is left in liquid form for a period of time prior to curing.

Figure 29:
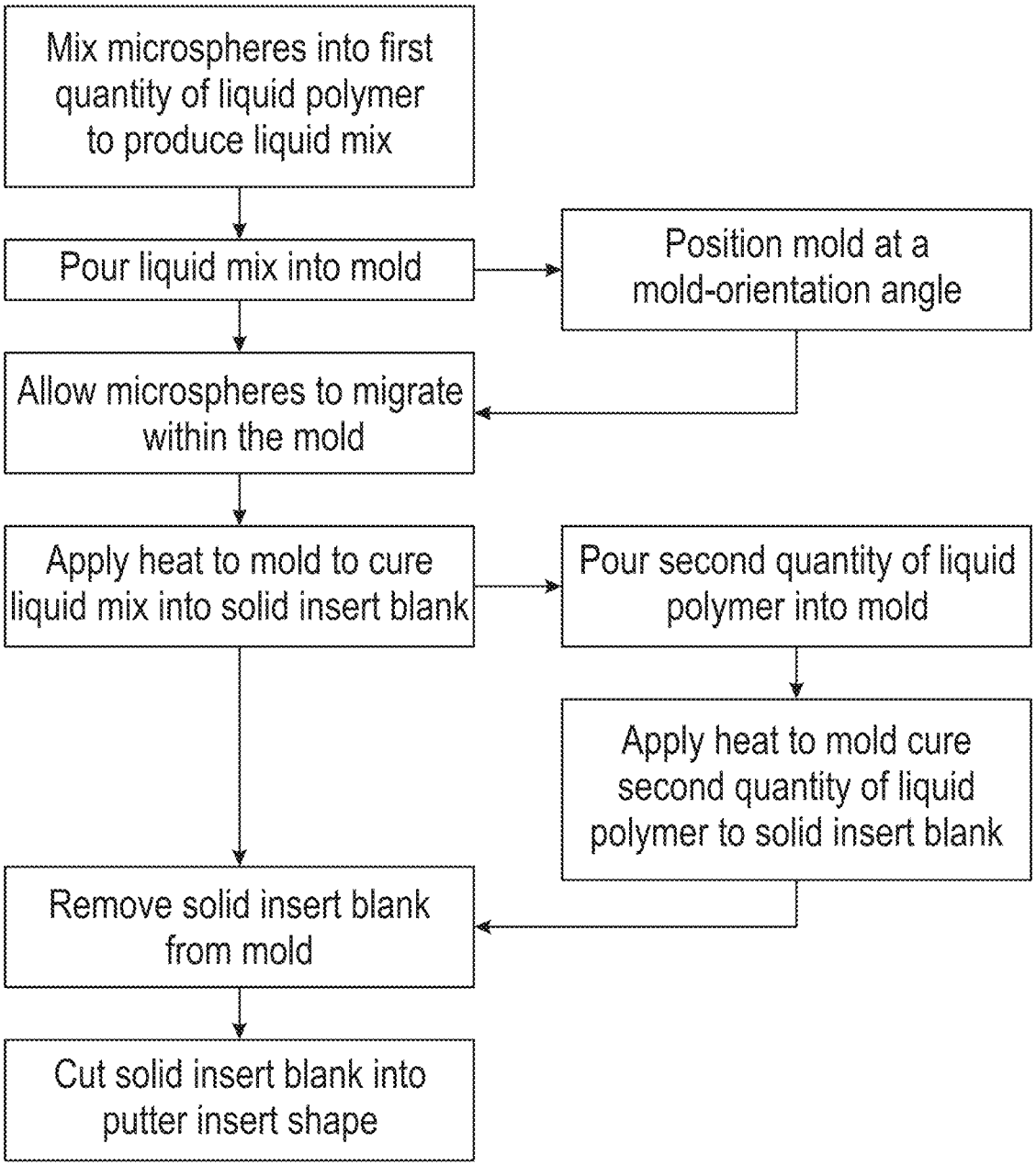
FIGS. 29-30 are process flow charts of methods of manufacturing putter face inserts in accordance with the present disclosure.

As illustrated in FIG. 29, manufacture of the golf club putter head insert includes the steps of: (a) mixing a plurality of microspheres into a first quantity of polymer to produce a liquid polymer—microsphere mix; then (b) pouring the liquid polymer—microsphere mix into a mold; (c) selecting a wait time; (d) selecting a first cure time; then (e) after the pouring step is completed, waiting for the wait time, such that a first quantity of the plurality of microspheres migrate from a first interior portion of the mold to a second interior portion of the mold, such that the concentration of microspheres in the first interior portion of the mold is less than the concentration of microspheres in the second interior portion of the mold, then (f) after the wait time is completed, applying heat to the mold for the first cure time, so as to cure the liquid polymer—microsphere mix into a solid insert blank; then (g) removing the solid insert blank from the mold; and (h) cutting the solid insert blank into a selected shape so as to form a finished putter insert.

In another embodiment of the method of making a putter insert, the method can include the additional steps of: (i) selecting a mold-orientation angle with respect to the ground; and (j) positioning the mold at the selected mold-orientation angle, so as to use gravity to control the direction of the migration of the first quantity of the plurality of microspheres from a first interior portion of the mold to a second interior portion of the mold, by positioning the first interior portion of the mold and the second interior portion of the mold with respect to the ground.

It may also be advantageous to form the putter insert using two or more separate polymer castings, in order to ensure that one of the castings—and therefore one of the layers or regions of the putter insert—is entirely free of microspheres, or contains a particularly advantageous type of microspheres, or contains a particularly advantageous density of microspheres. In this embodiment of the method, after the solid insert blank is cured, the method further includes: (k) pouring a second quantity of liquid polymer into the mold; and (1) applying heat to the mold for the second cure time, so as to cure the second quantity liquid polymer and bonding the second quantity of liquid polymer to the solid insert blank.

In another embodiment of the method of making a putter insert, the method also includes selecting microspheres and polymer, where the plurality of microspheres have a first specific gravity and the first quantity of polymer has a second specific gravity, and where the first specific gravity is less than the second specific gravity, such that, during the wait time, the first quantity of the plurality of microspheres migrate in an upward direction from a first interior portion of the mold to a second interior portion of the mold due to the effect of gravity.

Figure 30:
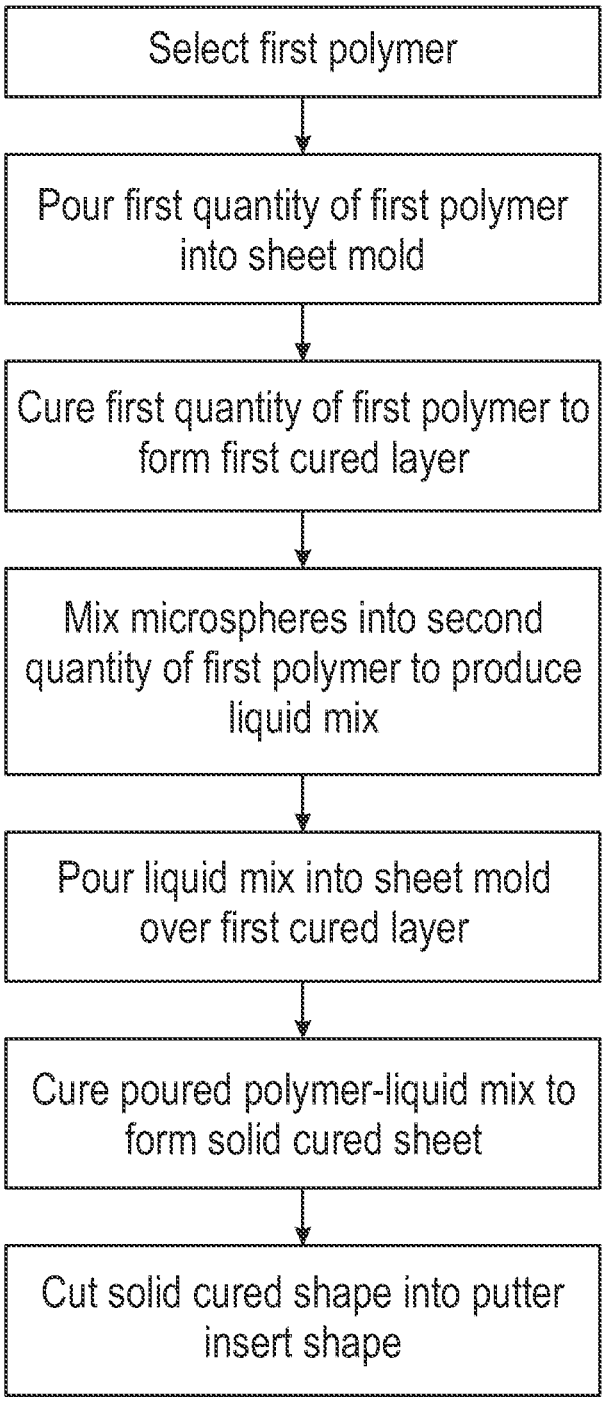

In a further aspect, illustrated in FIG. 30, an alternative method of making a golf club putter head insert includes selecting a first polymer, pouring a first quantity of the first polymer into a sheet mold, curing the first quantity of the first polymer to form a first cured layer, mixing a plurality of microspheres into a second quantity of the first polymer to produce a liquid polymer—microsphere mix, then pouring the liquid polymer—microsphere mix into the sheet mold over the first cured layer, curing the poured liquid polymer—microsphere mix to form a second cured layer bonded to the first cured layer, so as to form a solid cured sheet, and then cutting the solid cured sheet into a selected shape so as to form a finished putter insert.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A method of making a golf club putter head insert comprising:

mixing a plurality of microspheres into a first quantity of polymer to produce a liquid polymer-microsphere mix;

pouring the liquid polymer-microsphere mix into a mold;

selecting a wait time;

selecting a first cure time;

after the pouring step is completed, waiting for the wait time, such that a first quantity of the plurality of microspheres migrate from a first interior portion of the mold to a second interior portion of the mold, such that a concentration of microspheres in the first interior portion of the mold is less than a concentration of microspheres in the second interior portion of the mold;

after the wait time is completed, applying heat to the mold for the first cure time, so as to cure the liquid polymer-microsphere mix into a solid insert blank;

removing the solid insert blank from the mold; and cutting the solid insert blank into a selected shape to form a finished golf club putter head insert.

2. The method of claim 1, further comprising:

selecting a mold-orientation angle with respect to a ground;

positioning the mold at the selected mold-orientation angle, so as to use gravity to control the direction of the migration of the first quantity of the plurality of microspheres from a first interior portion of the mold to a second interior portion of the mold, by positioning the first interior portion of the mold and the second interior portion of the mold with respect to the ground.

3. The method of claim 1, further comprising:

after the solid insert blank is cured, pouring a second quantity of liquid polymer into the mold; and applying heat to the mold for the second cure time, so as to cure the second quantity liquid polymer and bonding the second quantity of liquid polymer to the solid insert blank.

* * * * *